US011697263B2

(12) United States Patent
Ohnishi et al.

(10) Patent No.: US 11,697,263 B2
(45) Date of Patent: Jul. 11, 2023

(54) FOLDER-GLUER

(71) Applicant: KABUSHIKI KAISHA ISOWA, Kasugai (JP)

(72) Inventors: Akihito Ohnishi, Tajimi (JP); Yukiomi Suzuki, Kasugai (JP); Shunsuke Nakanishi, Komaki (JP)

(73) Assignee: KABUSHIKI KAISHA ISOWA, Aichi (JP)

( * ) Notice: Subject to any disclaimer, the term of this patent is extended or adjusted under 35 U.S.C. 154(b) by 0 days.

(21) Appl. No.: 17/565,867

(22) Filed: Dec. 30, 2021

(65) Prior Publication Data

US 2022/0234322 A1 Jul. 28, 2022

(30) Foreign Application Priority Data

Jan. 27, 2021 (JP) ..... JP2021-010978

(51) Int. Cl.
*B31B 50/62* (2017.01)
*B31B 50/26* (2017.01)
*B31B 100/00* (2017.01)

(52) U.S. Cl.
CPC ..... *B31B 50/62* (2017.08); *B31B 50/262* (2017.08); *B31B 2100/00* (2017.08)

(58) Field of Classification Search
CPC ... B31B 50/62; B31B 50/262; B31B 2100/00; B31B 50/58; B31B 50/26; B31B 2100/002; B31B 2110/10
USPC ..... 493/162
See application file for complete search history.

(56) References Cited

U.S. PATENT DOCUMENTS 3,611,884 A * 10/1971 Hottendorf ..... B31B 50/00 493/82
4,254,692 A * 3/1981 Sardella ..... B31B 50/56 493/179
4,295,841 A * 10/1981 Ward, Jr. ..... B31B 50/00 493/437
8,911,338 B2 12/2014 Ishizuka
9,833,963 B2 * 12/2017 Nadachi ..... B31B 50/36
2016/0243784 A1 * 8/2016 Ishizuka ..... B31B 50/042
2018/0362285 A1 * 12/2018 Suzuki ..... B65H 31/32

FOREIGN PATENT DOCUMENTS

JP 5895316 B 3/2016

* cited by examiner

*Primary Examiner* — Sameh Tawfik
(74) *Attorney, Agent, or Firm* — Crowell & Moring LLP

(57) ABSTRACT

In a folder-gluer, push-out forces by an air cylinder and a push-out spring mechanism are set such that: (1) when downstream portions of first and fourth panels are passing through a second bending plate, the second bending plate is pushed outwardly in a width direction by the push-out forces to extend the downstream portions of the first and fourth panels in the width direction; and (2) when upstream portions of the first and fourth panels are passing through the second bending plate, the second bending plate is pushed back inwardly in the width direction by the resistance force applied to the second bending plate by the first and fourth panels so as not to extend the upstream portions in the width direction, and wherein the push-out forces are not varied by a control while the first and fourth panels are passing through the second bending plate.

12 Claims, 22 Drawing Sheets

FOLDER-GLUER

RELATED APPLICATIONS

This application claims priority to Japanese Patent Application No. 2021-010978, filed on Jan. 27, 2021, the entire content of which is incorporated herein by reference.

BACKGROUND OF THE INVENTION

1. Field of the Invention

The present invention relates to a folder-gluer, and more particularly to a folder-gluer for folding and gluing a corrugated paperboard sheet having four panels and a joint flap.

2. Description of the Related Art

Generally, a corrugated paperboard box making machine is configured to perform slotting and creasing to thereby form, in a corrugated paperboard sheet, a plurality of slots and crease lines each extending in a conveyance direction. The corrugated paperboard sheet is designed to be formed as a box, i.e., has four panels and a joint flap. A folder-gluer is one processing unit comprised in the corrugated paperboard box making machine, and configured to fold endmost two of the four panels of the corrugated paperboard sheet by 180 degrees, and glue one of the folded panels to the joint flap. During conveyance of the corrugated paperboard sheet at high speed, each of the two endmost panels is folded through contact between an outside surface of the panel and a bending bar or bending belt.

With reference to FIGS. 21 to 23, one example of a conventional folder-gluer will be described. A conventional folder-gluer 90 comprises: a frame 92; a conveyance device (upper conveyor belt and a lower conveyor belt) 94 for conveying a corrugated paperboard sheet SS comprising first to fourth panels P1 to P4; a first bending station 96 for bending each of the endmost first and fourth panels P1, P4 of the corrugated paperboard sheet SS from 0 degree to about 90 degrees; and a second bending station (not illustrated) for bending each of the endmost panels from about 90 degrees to 180 degrees.

In order to bend the two endmost panels P1, P4 of the corrugated paperboard sheet SS from 0 degree to about 90 degrees, the first bending station 96 illustrated in FIGS. 21 and 22 employs a pair of bending bars 98 configured to come into contact with respective outside surfaces of the endmost first and fourth panels P1, P4, and a pair of bending plates 100 each configured to allow a respective one of the two endmost panels to be bent along an associated crease line. Each of the bending plates 100 tends to be arranged such that a distal end (upper end) thereof is located slightly inwardly in a width direction with respect to a position of the crease line along which the first and fourth panels P1, P4 is to be bent. The reason is as follows. Since the corrugated paperboard sheet SS has a certain thickness, if the distal end of the bending plate 100 is located just at the position of the crease line, the corrugated paperboard sheet SS bulges along with the bending, the distal end is pinched between edges of the bulged portion of the corrugated paperboard sheet SS, and resulting friction makes it impossible to successfully convey the corrugated paperboard sheet SS. The above arrangement is intended to prevent the occurrence of this situation.

As above, there is a slight distance between the distal end of the bending die plate 100 and the position of the crease line, so that, due to contact frictional resistance between respective ones of the bending bars 98 and conveyance-directional leading edge regions (downstream edge regions) of the endmost first and fourth panels P1, P4 of the corrugated paperboard sheet SS being conveyed, a fold line of each of the first and fourth panels P1, P4 is shifted inwardly in the width direction with respect to the position of the crease line, in the leading edge region of the corrugated paperboard sheet SS, and thereby each of the endmost first and fourth panels P1, P4 has a posture where it is inclined outwardly in the width direction (see FIG. 22).

Then, the corrugated paperboard sheet having the endmost first and fourth panels P1, P4 bent in the inclined posture is introduced into a last-half (downstream) zone of the folder-gluer, and each of the first and fourth panels P1, P4 is further bent from about 90 degrees to 180 degrees, while being guided by a corresponding one of two sets of a plurality of gauge rollers (guide rollers) disposed on both sides of the corrugated paperboard sheet. In this case, the bending is progressed while each of the first and fourth panels P1, P4 is kept in the inclined posture, so that a box is formed such that the fold lines of the first and fourth panels P1, P4 are inclined (skewed) in a fishtail shape toward an upstream side in the conveyance direction. This "fishtail" problem is more likely to occur, as the corrugated paperboard sheet has a larger box depth dimension in the conveyance direction.

FIG. 23 illustrates a folded corrugated paperboard sheet SS produced by the above folder-gluer, wherein the fishtail occurs in this corrugated paperboard sheet SS. In particular, a gap between edge regions of the two endmost panels on a downstream side in the conveyance direction is "A" (especially, "−A"), and a gap between edge regions of the two endmost panels on the upstream side is "B", so that a difference between the upstream-side and downstream-side gaps between the two endmost panels is "A+B". That is, in the folded corrugated paperboard sheet SS, the fold lines obliquely extend in a direction from the downstream side to the upstream side to form a fishtail shape.

With a view to preventing the occurrence of the fishtail in a corrugated paperboard sheet, various techniques have heretofore been proposed. For example, a folder-gluer disclosed in JP 5895316 B (Patent Document 1) pushes and moves a bending member outward in the width direction for a predetermined period of time after a sensor detects a passage of the corrugated paperboard sheet on the upstream side of the bending member, and therefore extends the downstream portions of the first and fourth panels in the width direction, so that a box having no fishtail shape can be made.

SUMMARY OF THE INVENTION

Technical Problem

The folder-gluer described in Patent Document 1 controls the timing of pushing the bending member outward in the width direction so as to extend only the downstream portions of the first and fourth panels in the width direction, and so as not to extend only the upstream portions of the first and fourth panels in the width direction, such that the occurrence of the fishtail is prevented. Therefore, in order to accurately control the timing of pushing out the bending member, the folder-gluer uses the sensor for detecting the passage of the corrugated paperboard sheet on the upstream side of the bending member and the control device for controlling the operation of the device for pushing out the bending member outward in the width direction. Accordingly, in the folder-gluer in Patent Document 1, there is a problem that using such a sensor and control device increases the costs of the apparatus.

The present invention has been made to solve the above-mentioned problems, and an object thereof is to provide a folder-gluer capable of appropriately producing boxes having no fishtail while avoiding an increase in costs of an apparatus.

Solution to Problem

In order to achieve the above object, the present invention provides a folder-gluer for, with respect to a corrugated paperboard sheet having first to fourth panels and a joint flap serially connected together through respective connection regions, folding each of the first panel and the fourth panel in the connection region thereof and gluing the folded first and fourth panels together through the joint flap, comprising: a conveyance device configured to convey the corrugated paperboard sheet; a pair of first bending members which extend in a conveyance direction of the corrugated paperboard sheet by the conveyance device, and respectively come into contact with outside surfaces of the first and fourth panels of the corrugated paperboard sheet being conveyed by the conveyance device, so as to bend the first and fourth panels from 0 degree to about 90 degrees; a pair of second bending members which extend in the conveyance direction, and are disposed inwardly in a width direction (sheet width direction) perpendicular to the conveyance direction, with respect to each of the first bending members, respectively, wherein the pair of second bending members are configured such that distal ends thereof come into contact, respectively, with a crease line formed in a reverse surface of the first panel or a vicinity of this crease line, and a crease line formed in a reverse surface of the fourth panel or a vicinity of this crease line, so as to bend the first and fourth panels of the corrugated paperboard sheet being conveyed by the conveyance device in cooperation with the pair of first bending members; and a push-out device configured to add a push-out force to each of the second bending members to push and move each of the second bending members outwardly in the width direction, wherein the push-out force by the push-out device is set such that: (1) when downstream portions of the first and fourth panels are passing through the pair of second bending members, the pair of second bending members are set to a state of being pushed outwardly in the width direction by the push-out force, and the downstream portions of the first and fourth panels are extended in the width direction by the pair of second bending members in this state; (2) next, when upstream portions relative to the downstream portions of the first and fourth panels are passing through the pair of second bending members, the pair of second bending members are set to a state of being pushed back inwardly in the width direction by a resistance force applied to the pair of second bending members by the first and fourth panels which are passing, and the upstream portions of the first and fourth panels are not extended in the width direction by the pair of second bending members; and (3) next, when the first and fourth panels have finished passing through the pair of second bending members, the pair of second bending members are returned to a state of being pushed outwardly in the width direction by the push-out force, wherein the push-out force is not varied by a control while the first and fourth panels are passing through the pair of second bending members.

According to the above present invention, the occurrence of the fishtail in the corrugated paperboard sheet can be prevented by extending only the downstream portions of the first and fourth panels in the width direction by the second bending member without extending the upstream portions of the first and fourth panels in the width direction WD by the second bending member, for the corrugated paperboard sheet to be conveyed. Especially, according to the present invention, an extension operation of the first and fourth panels can be realized by using the push-out force which is set to a desired amount as described above and which is not varied by the control while the first and fourth panels are passing through the second bending member. Therefore, it is not necessary to use the sensor(s) and the control device as described in Patent Document 1, in order to realize the extension operation of the first and fourth panels. Specifically, while the first and fourth panels are passing through the second bending member, it is not necessary to control the push-out force applied to the second bending member by the control device according to the detection result of the sensor. Accordingly, according to the present invention, it is possible to appropriately produce boxes having no fishtail while avoiding an increase in cost of an apparatus.

Preferably, in the folder-gluer of the present invention, when a length of each of the second bending members along the conveyance direction is defined as "L", and a distance between leading edges of two adjacent corrugated paperboard sheets in the conveyance direction is defined as "N", and a box depth dimension of a box produced by the corrugated paperboard sheet is defined as "F", each of the second bending members is configured such that the length thereof satisfies an equation "$L \leq N-F$".

According to the above present invention, when the downstream end of the panel portion of the corrugated paperboard sheet to be conveyed reaches the upstream end of the second bending member, it is possible to avoid that the second bending member is maintained in a state of being pushed back to a substantially initial position by a resistance applied by the panel portion of the adjacent preceding corrugated paperboard sheet. Therefore, when each of the panel portions in the corrugated paperboard sheets continuously conveyed reaches the second bending member, the second bending member can be reliably returned to the state of being pushed outwardly in the width direction by the push-out force by the push-out device. Accordingly, the downstream portions of the first and fourth panels can be reliably extended in the width direction by the second bending member, for each of the corrugated paperboard sheets continuously conveyed.

Preferably, in the folder-gluer of the present invention, the push-out device comprises a push-out spring which applies the push-out force to each of the second bending members by elasticity.

According to the above present invention, since the push-out spring has a characteristic of high agility when returning from a compressed state, the push-out force can be quickly applied to the second bending member when the first and fourth panels have finished passing through the second bending member. Therefore, the second bending member can be quickly returned to the state of being pushed outwardly in the width direction.

Preferably, in the folder-gluer of the present invention, the push-out device comprises an air cylinder which applies the push-out force to each of the second bending members by high-pressure air.

Since the push-out force of the air cylinder is less affected by a widthwise position of the second bending member, the air cylinder has such a characteristic that it is easy to maintain a desired push-out force. Therefore, according to the above present invention, by using the air cylinder, it is possible to accurately realize the desired push-out force to be applied to the second bending member for performing the extension operation of the first and fourth panels, when the first and fourth panels are passing through the second bending member.

Preferably, in the folder-gluer of the present invention, the push-out device comprises: a push-out spring which applies the push-out force to each of the second bending members by elasticity; and an air cylinder which applies the push-out force to each of the second bending members by high-pressure air.

According to the above present invention, by using both the air cylinder and the push-out spring, it is possible to accurately perform the desired extension operation by the first and fourth panels when the first and fourth panels are passing through the second bending member, and it is possible to quickly the second bending member to the state of being pushed outwardly in the width direction when the first and fourth panels have finished passing through the second bending member.

Preferably, the folder-gluer of the present invention further comprises a mechanism capable of adjusting an initial compression amount of the push-out spring of the push-out device to vary a magnitude of the push-out force.

According to the above present invention, it is possible to accurately vary the push-out force applied by the push-out spring by adjusting the initial compression amount of the push-out spring, in accordance with the characteristics of the corrugated paperboard sheet to be conveyed, for example, the size, weight and material.

Preferably, the folder-gluer of the present invention further comprises a mechanism capable of adjusting a pressure of the high-pressure air supplied to the air cylinder of the push-out device to vary a magnitude of the push-out force.

According to the above present invention, it is possible to accurately vary the push-out force applied by the air cylinder by adjusting the pressure of the high-pressure air supplied to the air cylinder, in accordance with the characteristics of the corrugated paperboard sheet to be conveyed, for example, the size, weight and material.

Preferably, in the folder-gluer of the present invention, the push-out spring of the push-out device is housed in a housing and one or both ends of the push-out spring are secured.

According to the above present invention, the push-out spring is not disposed to be biased downward in the gravity direction, in the housing. Therefore, it is possible to prevent a friction between the push-out spring and the bottom surface inside the housing in accordance with the expansion and contraction in the width direction.

Preferably, the folder-gluer of the present invention further comprises a frame to which each of the second bending members is attached, and which comprises a support member for supporting each of the second bending members, wherein each of the second bending members comprises a guide member which engages with the support member of the frame and slides with respect to the support member so that each of the second bending members can move in the width direction, and wherein a surface of the guide member engaged with the support member is made of a material softer than a material of the support member.

According to the above present invention, since the second bending member moves in the width direction with the guide member thereof engaged with the support member of the frame, it is possible to ensure the accuracy of the movement in a traveling direction. Additionally, according to the present invention, since the surface (in other words, an abutting surface, or a sliding surface) of the guide member engaged with the support member is made of the material softer than the material of the support member, the wear of the support member can be suppressed by wearing only the guide member. Therefore, it is not necessary to replace the frame which is a large component, and only the guide member may be replaced. Accordingly, time and effort required for a replacement work can be reduced, and costs of the replacement work can be reduced at low cost.

Preferably, in the folder-gluer of the present invention, the guide member is further configured by a member which does not require lubrication by oiling.

According to the above present invention, it is possible to eliminate a need for periodic oiling of the surface of the guide member engaged with the support member.

Preferably, the folder-gluer of the present invention further comprises a frame to which each of the second bending members is attached, and which comprises a support member for supporting each of the second bending members, wherein each of the second bending members comprises a guide member which engages with the support member of the frame and includes a rolling part configured to roll over the support member so that each of the second bending members can move in the width direction.

According to the above present invention, since the second bending member moves in the width direction with the guide member thereof engaged with the support member of the frame, it is also possible to ensure the accuracy of the movement in the traveling direction. Also, according to the present invention, since the rolling part of the guide member rolls over the support member during the movement of the second bending member in the width direction, the wear of the support member can be suppressed. Therefore, it is not necessary to replace the frame which is a large component, and only the guide member (especially, the rolling part) may be replaced. Accordingly, time and effort required for a replacement work can be reduced, and costs of the replacement work can be reduced at low cost.

Preferably, in the folder-gluer of the present invention, each of the second bending members is configured such that a distal end part including a distal end can be removed and replaced from a main body part.

According to the above present invention, only the distal end part including the distal end which is prone to wear can be replaced. Therefore, even if the distal end wears, since it is not necessary to replace the entire second bent member which is a large component, time and effort required for a replacement work can be reduced, and costs of the replacement work can be reduced at low cost.

The folder-gluer of the present invention makes it possible to appropriately produce the boxes having no fishtail while avoiding the increase in the costs of the apparatus.

DETAILED DESCRIPTION OF THE PREFERRED EMBODIMENTS

With reference to the accompanying drawings, a folder-gluer of the present invention will now be described based on one embodiment thereof.

At first, the folder-gluer is a part of a corrugated paperboard box making machine in which a large number of processing units including the folder-gluer are disposed along a conveyance direction of a corrugated paperboard sheet. The corrugated paperboard box making machine comprises, on an upstream side of the folder-gluer, a corrugated paperboard sheet feeding unit, a printing unit, and a creaser-slotter unit for creasing and slotting a corrugated paperboard sheet, and further comprises, on a downstream side of the folder-gluer, a counter-ejector unit for accumulating and ejecting a plurality of folded and glued corrugated paperboard sheets.

Figure 1:
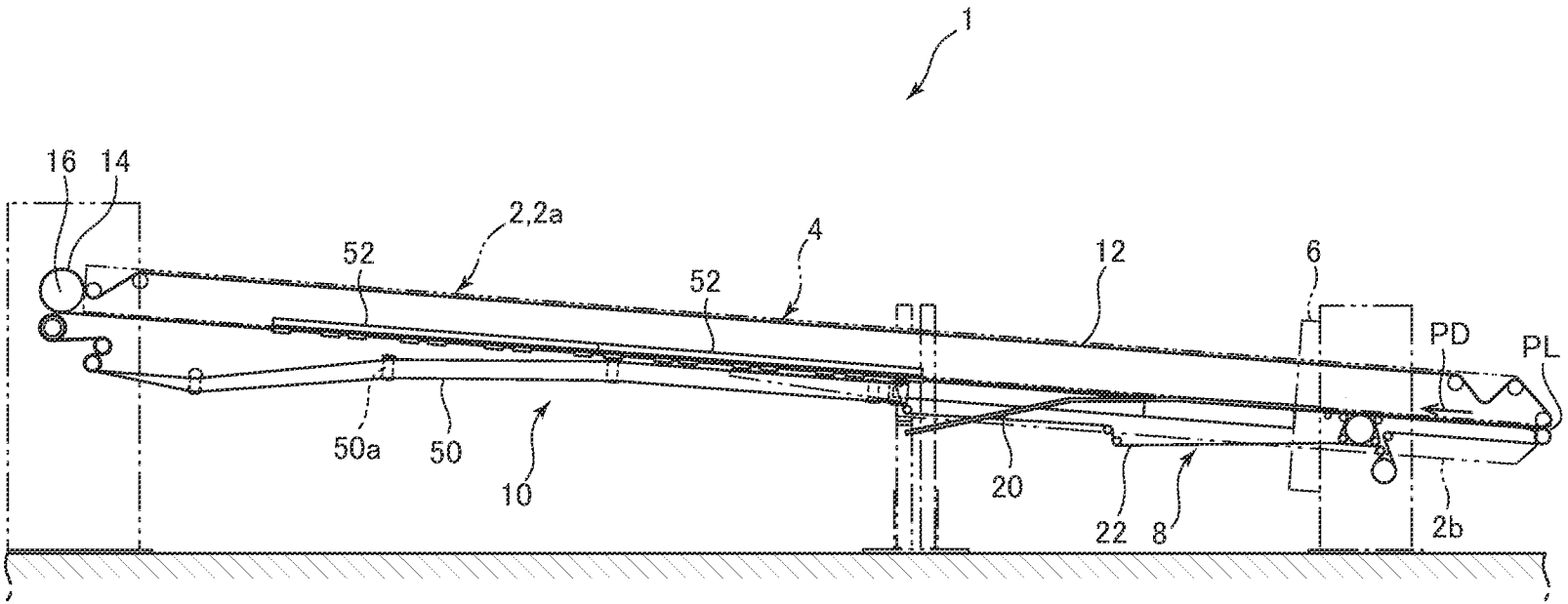
FIG. 1 is a schematic diagram illustrating an overall structure of a folder-gluer according to one embodiment of the present invention.
Figure 2:
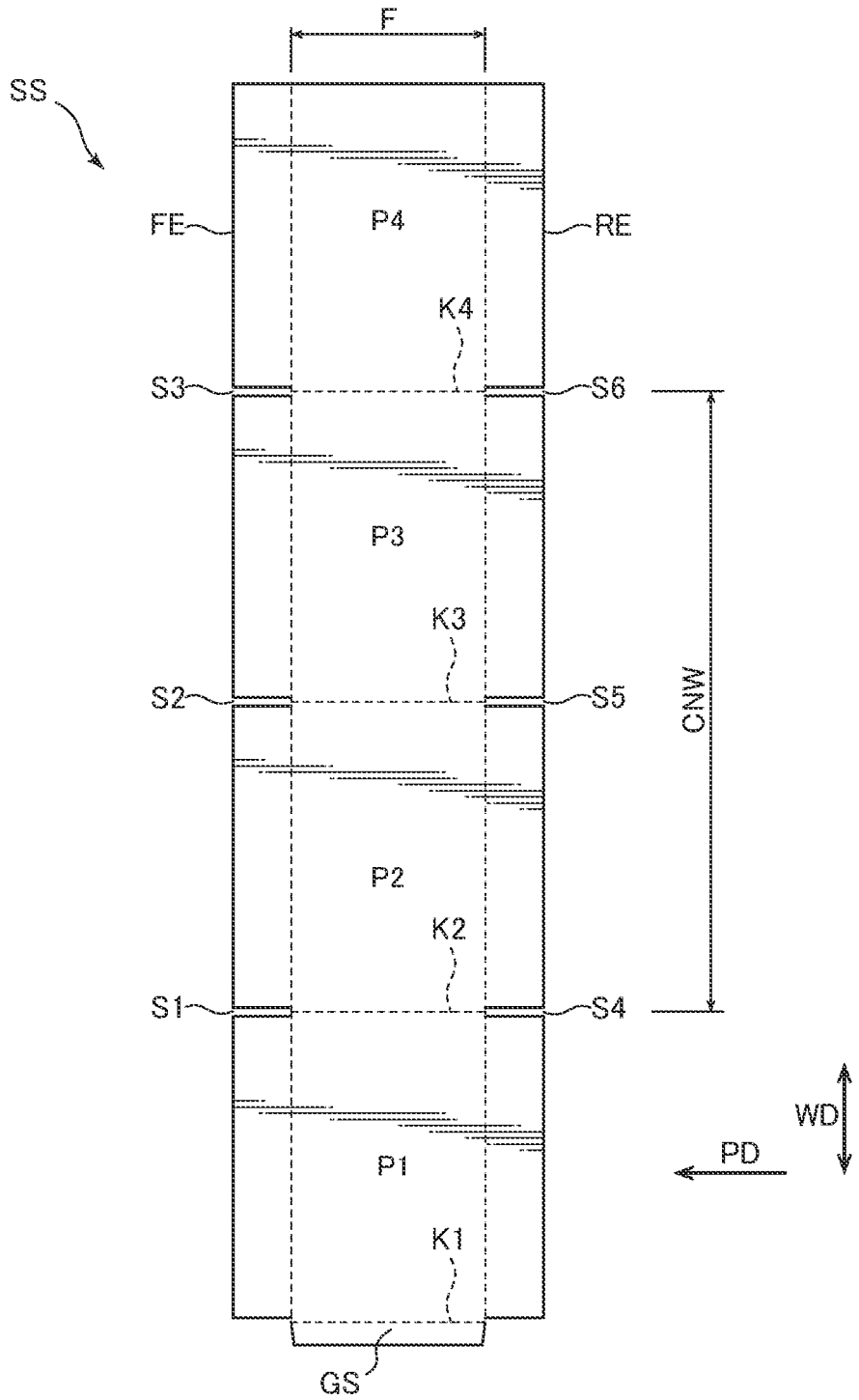
FIG. 2 is a top plan view illustrating a both-side flap type corrugated paperboard sheet.

With reference to FIGS. 1 and 2, an overall structure of the folder-gluer according to this embodiment will be described. FIG. 1 is a schematic diagram illustrating an overall structure of the folder-gluer according to this embodiment, and FIG. 2 is a top plan view illustrating a both-side flap type corrugated paperboard sheet.

As illustrated in FIG. 1, the folder-gluer 1 according to this embodiment is disposed along a conveyance direction PD and configured to fold and glue a both-side flap type corrugated paperboard sheet SS (see FIG. 2).

As illustrated in FIG. 2, the both-side flap type corrugated paperboard sheet SS has first to fourth panels P1 to P4 along a width direction WD (sheet width direction) perpendicular to the conveyance direction PD; and a joint flap GS on a left side of the first panel P1. The creaser-slotter unit (not illustrated) disposed on the upstream side of the folder-gluer 1 is operable to form four crease lines K1 to K4, respectively, in a connection region between the first panel P1 and the joint flap GS, and three connection regions between respective adjacent ones of the first to fourth panels P1 to P4, and to form three slit-like slots S1 to S3 in a region adjacent to a leading edge FE of the corrugated paperboard sheet SS, and three slit-like slots S4 to S6 in a region adjacent to a trailing edge RE of the corrugated paperboard sheet SS. Each of the connection regions has a given box depth dimension F in a direction parallel to the conveyance direction PD, and a distance between the connection region formed with the crease line K2 and the connection region formed with the crease line K4 is a given widthwise distance CNW along the sheet width direction WD. The crease lines K1 to K4 are formed in respective reverse surfaces of the first to fourth panels P1 to P4. On the other hand, the "corrugated paperboard sheet" in the present invention may be a sheet having the first to fourth panels and the joint flap, and is not limited to a sheet having flaps connected to the first to fourth panels. For example, the corrugated paperboard sheet may be a sheet which does not have either one or both of the upstream side and downstream side flaps connected to the first to fourth panels.

As illustrated in FIG. 1, the folder-gluer 1 comprises: a frame 2; a conveyance device 4 for conveying the corrugated paperboard sheet SS along a conveyance pathway PL; a glue application device 6 for applying glue to the joint flap GS of the corrugated paperboard sheet SS; a first bending station 8 for bending the endmost, first and fourth panels P1, P4 of the corrugated paperboard sheet SS from its flat state (0 degree) to about 90 degrees; and a second bending station 10 for bending the first and fourth panels P1, P4 from about 90 degrees to 180 degrees.

The frame 2 comprises an upper frame 2*a* and a lower frame 2*b*, which are configured to allow aforementioned various components to be attached thereto.

The conveyance device 4 comprises a pair of upper conveyor belts 12 provided on right and left sides of the conveyance pathway PL, in a tensioned state. The upper conveyor belts 12 are disposed along and above the conveyance pathway PL, over the overall length of the folder-gluer 1, and only a part thereof corresponding to the second bending station 10 is formed as a suction type configured to convey the corrugated paperboard sheet SS while suction-holding an upper surface of the corrugated paperboard sheet SS. A conveyance motor 14 is provided to drive the upper conveyor belts 12, and a conveyance amount detector 16 is coupled to a rotary shaft of the conveyance motor 14 to detect a conveyance amount by the upper conveyor belts 12. A distance between the upper conveyor belts 12 in the width direction WD is adjustable depending on the given widthwise distance CNW of the corrugated paperboard sheet SS.

The glue application device 6 is disposed adjacent to a feed port of the folder-gluer 1 through which the corrugated paperboard sheet SS is fed into the folder-gluer 1. The glue application device 6 is configured to apply glue to the joint flap GS of the corrugated paperboard sheet SS being conveyed from the feed port. The joint flap GS applied with glue is bonded to the fourth panel P4 by a joining roller, when the corrugated paperboard sheet SS is discharged from the folder-gluer 1.

Figure 3:
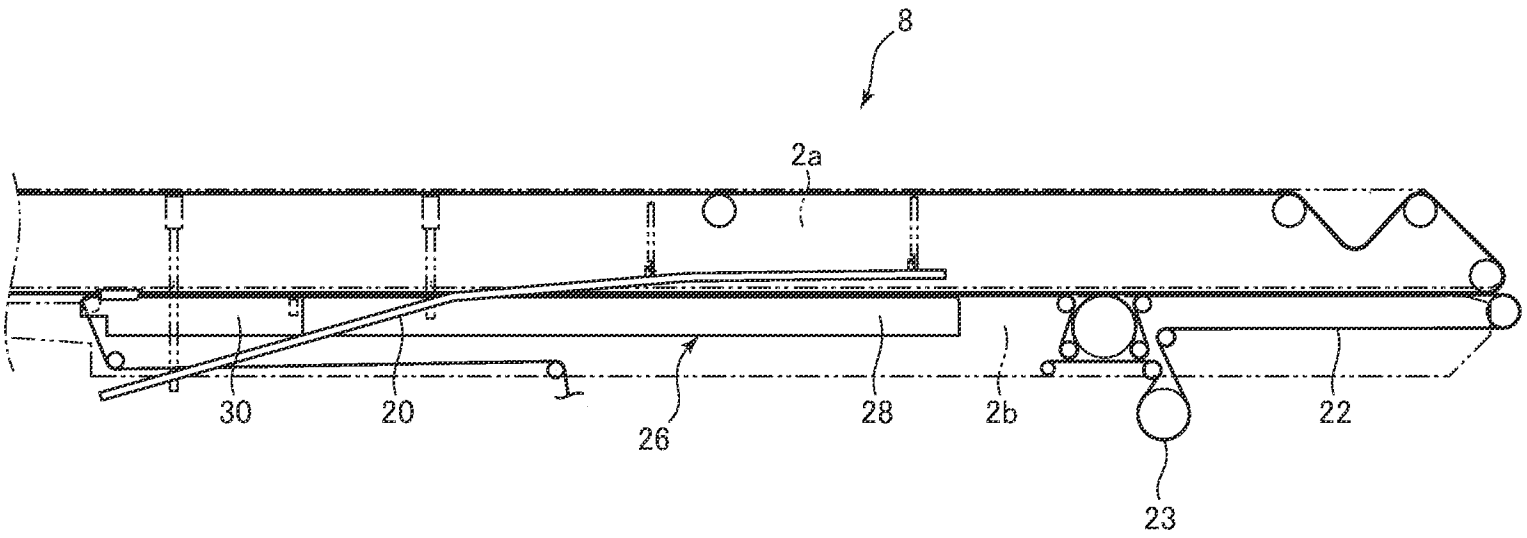
FIG. 3 is a side view illustrating a first bending station of the folder-gluer according to this embodiment.
Figure 4:
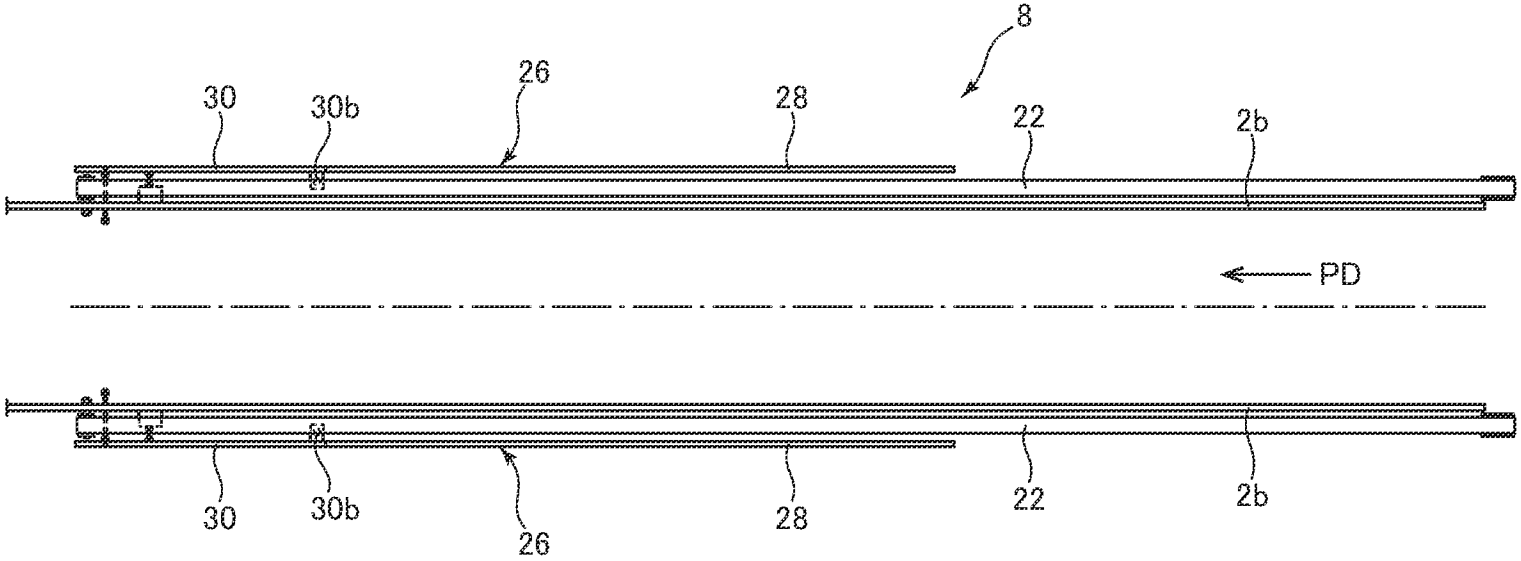
FIG. 4 is a top plan view illustrating the first bending station in FIG. 3.
Figure 5:
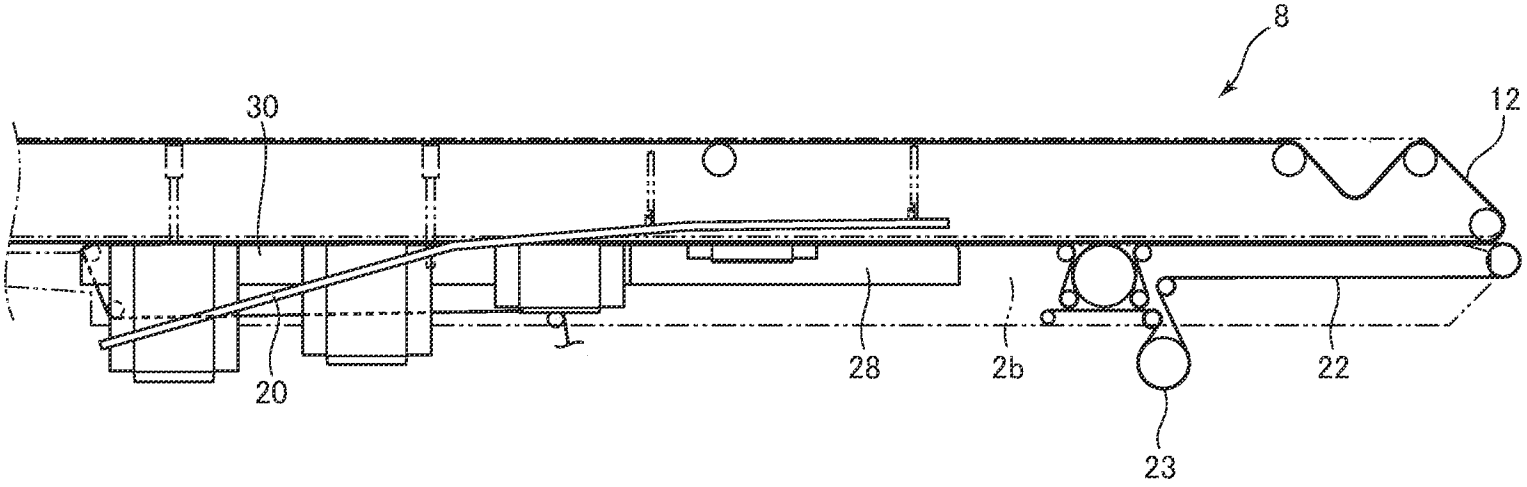
FIG. 5 is a side view illustrating the first bending station in a state where the corrugated paperboard sheet is being bent by the folder-gluer according to this embodiment.
Figure 6:
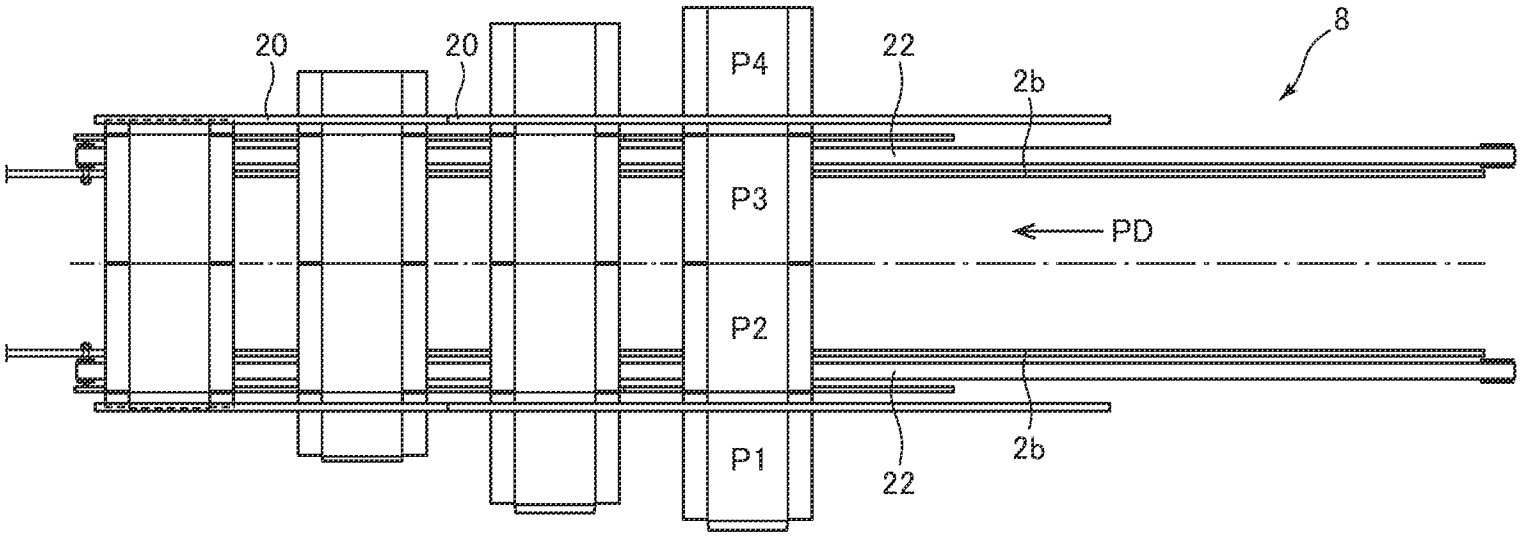
FIG. 6 is a top plan view illustrating the first bending station in FIG. 5.
Figure 7:
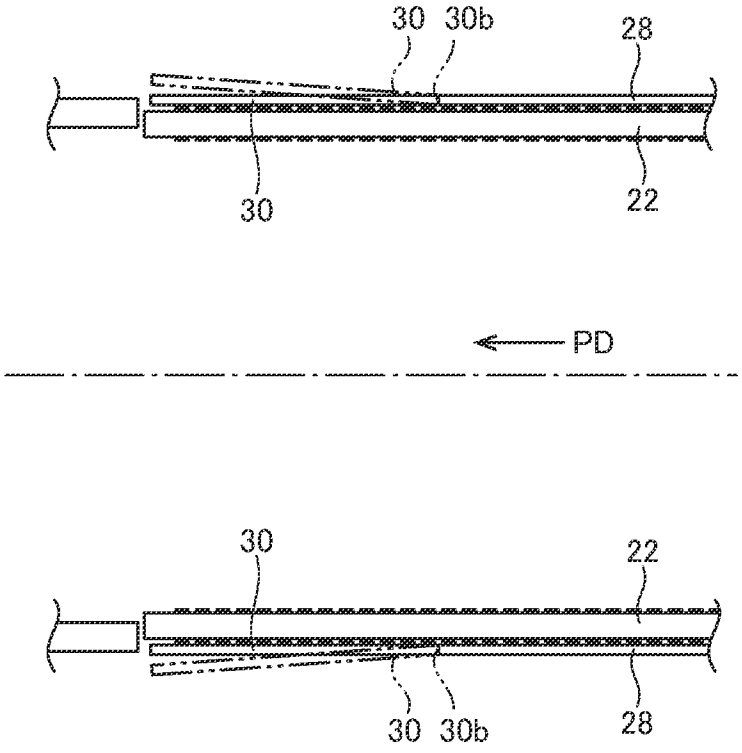
FIG. 7 is a schematic top plan view illustrating a swinging movement of a second bending plate in the first bending station of the folder-gluer according to this embodiment.
Figure 8:
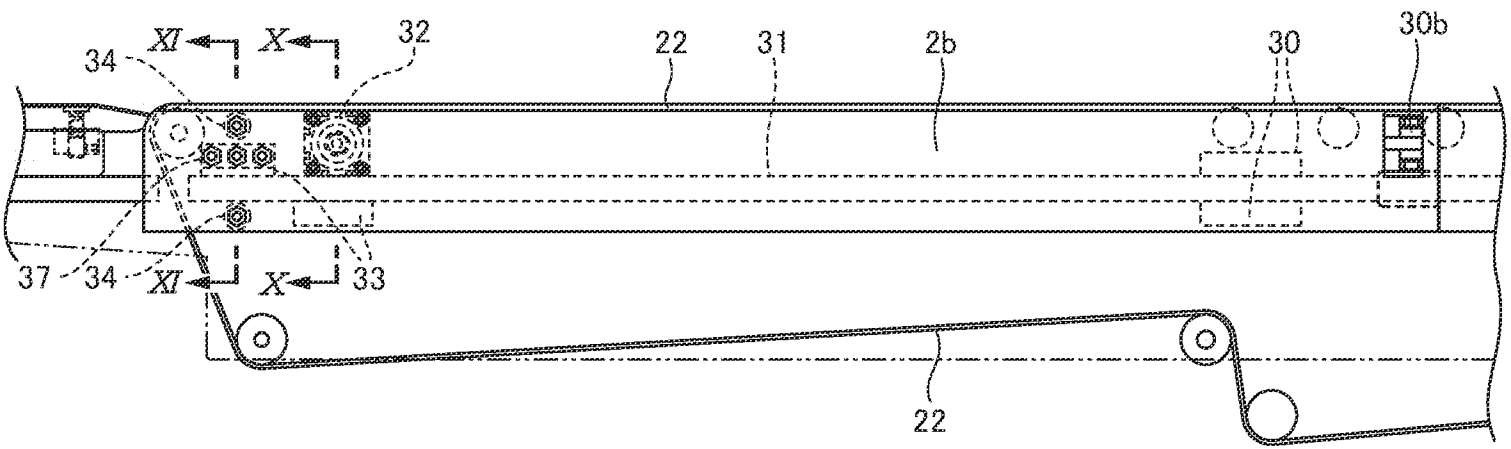
FIG. 8 is an enlarged side view illustrating the second bending plate in the folder-gluer according to this embodiment.
Figure 9:
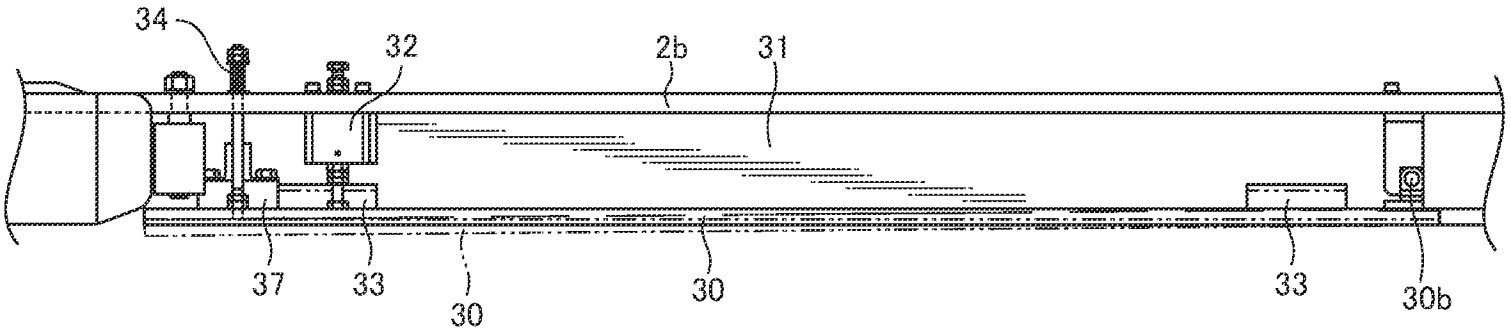
FIG. 9 is an enlarged top plan view illustrating the second bending plate in FIG. 8.
Figure 10:
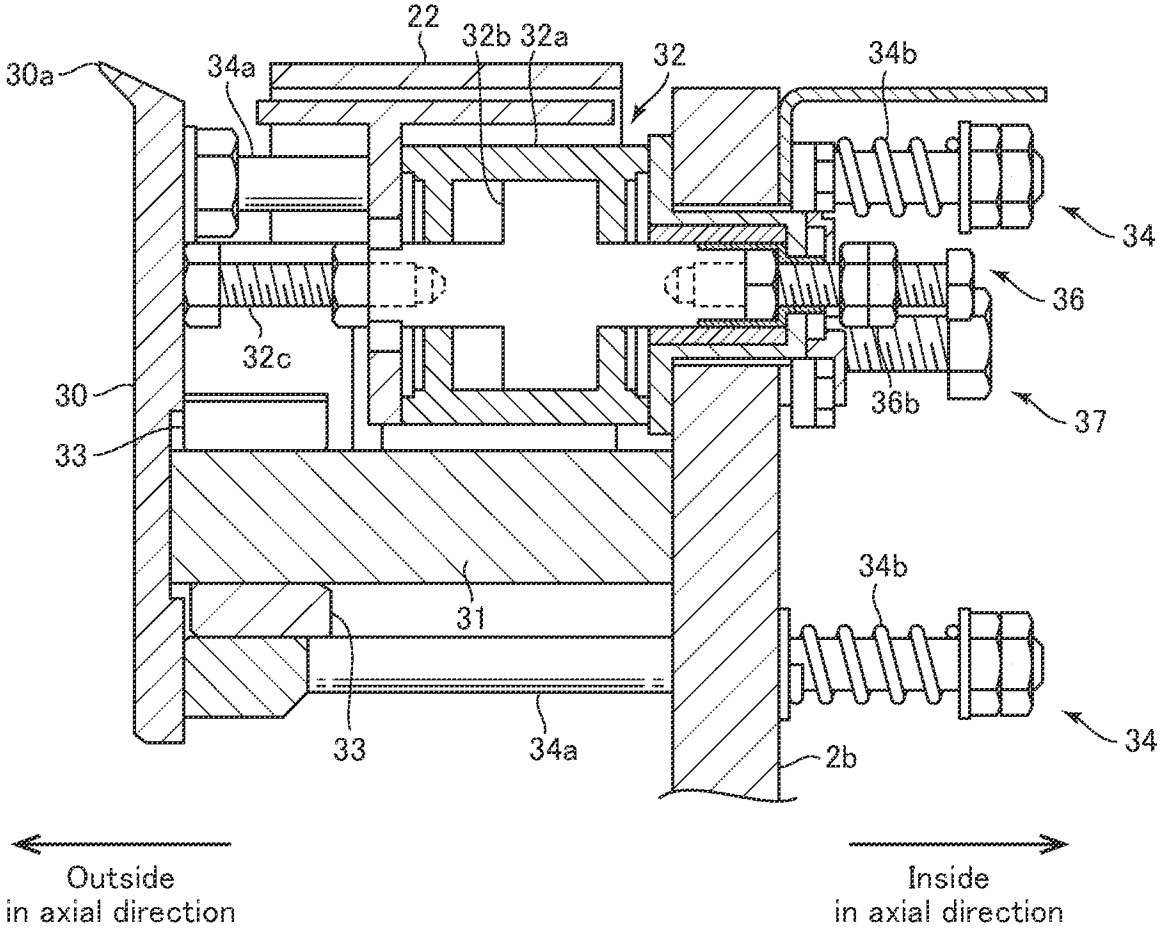
FIG. 10 is an enlarged cross-sectional view of the folder-gluer according to this embodiment, taken along the line X-X in FIG. 8.
Figure 11:
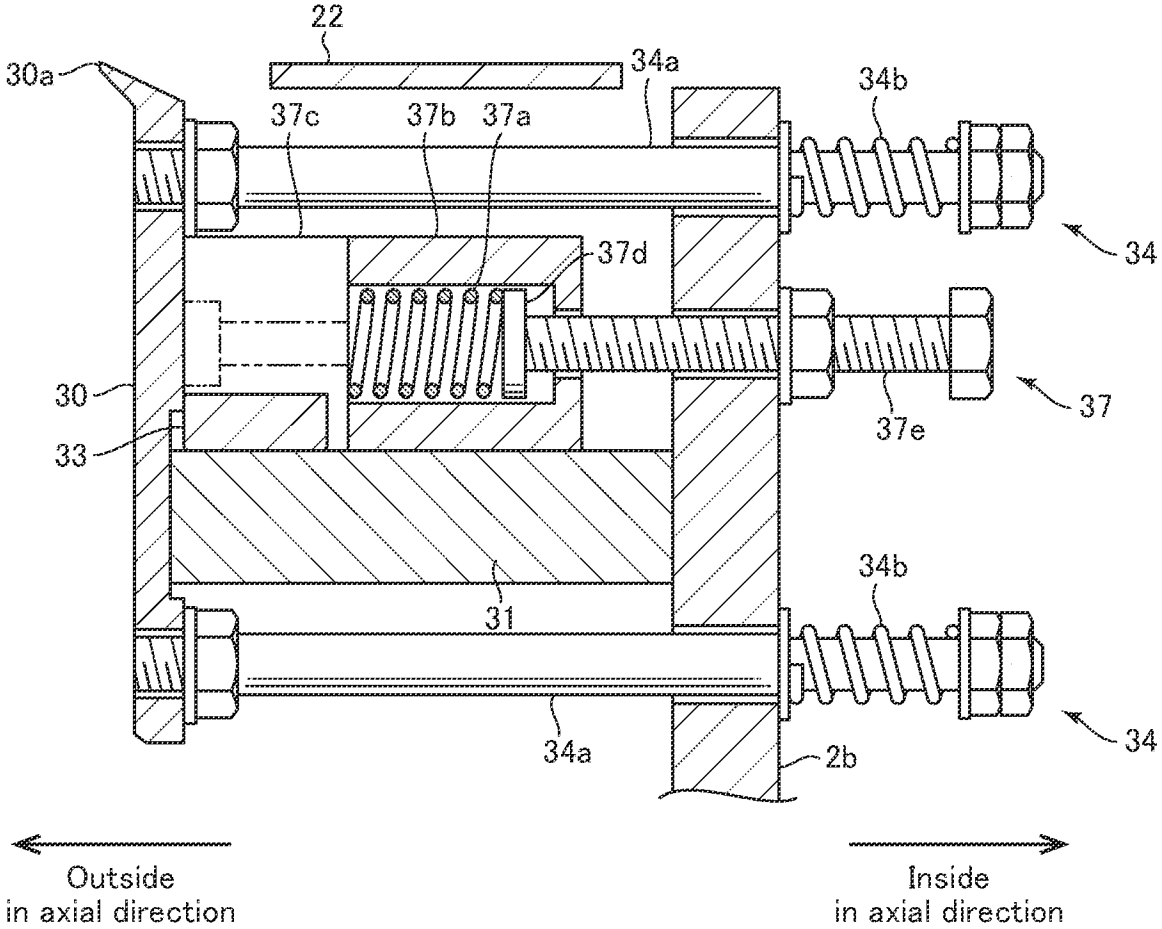
FIG. 11 is an enlarged cross-sectional view of the folder-gluer according to this embodiment, taken along the line XI-XI in FIG. 8.
Figure 12:
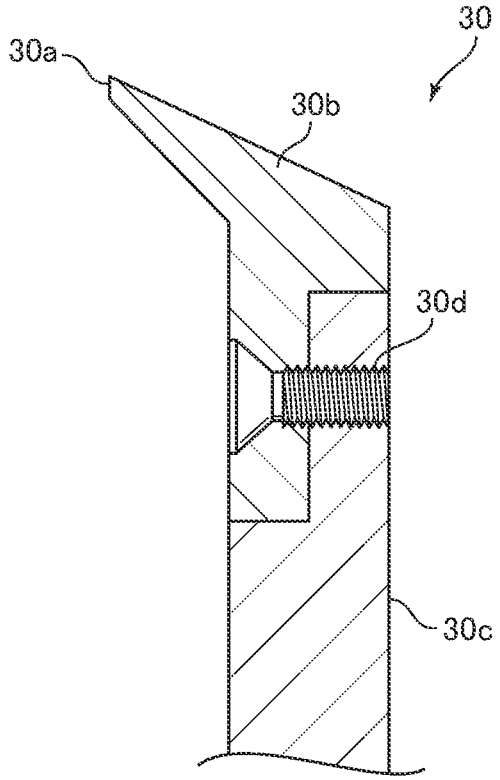
FIG. 12 is an enlarged side view illustrating the distal end part of the second bending plate according to this embodiment.

With reference to FIGS. 3 to 12, the first bending station 8 of the folder-gluer 1 will be described below. FIG. 3 is a side view illustrating the first bending station, and FIG. 4 is a top plan view illustrating the first bending station in FIG. 3. FIG. 5 is a side view illustrating the first bending station in a state where the corrugated paperboard sheet is being bent, and FIG. 6 is a top plan view illustrating the first bending station in FIG. 5. FIG. 7 is a schematic top plan view illustrating a swinging movement of a second bending plate in the first bending station. FIG. 8 is an enlarged side view illustrating the second bending plate in the folder-gluer according to this embodiment, and FIG. 9 is an enlarged top plan view illustrating the second bending plate in FIG. 8. FIG. 10 is an enlarged cross-sectional view of the folder-gluer taken along the line X-X in FIG. 8. FIG. 11 is an enlarged cross-sectional view of the folder-gluer taken along the line XI-XI in FIG. 8. FIG. 12 is an enlarged side view illustrating the distal end part of the second bending plate.

The first bending station 8 is designed to bend the endmost, first and fourth panels P1, P4 of the corrugated paperboard sheet SS from its flat state (0 degree) to about 90 degrees. The first bending station 8 is equipped with a pair of bending bars 20 disposed on both sides of the conveyance pathway PL, and a pair of lower conveyor belts 22 for conveying the corrugated paperboard sheet SS while supporting the corrugated paperboard sheet SS from therebelow.

Each of the bending bars 20 is disposed to extend from the corrugated paperboard sheet feed port of the folder-gluer 1 to an upstream region of the second bending station 10, and fixed to the upper frame 2*a* of the folder-gluer 1. An upstream portion of the bending bar 20 is located above the conveyance pathway PL, and the bending bar 20 is gradually lowered toward an upstream side to a position below the conveyance pathway PL. Thus, when an outer surface of each of the first and fourth panels P1, P4 comes into contact with a corresponding one of the bending bars 20, each of the first and fourth panels P1, P4 is bent from 0 degree to about 90 degrees. Each of the lower conveyor belts 22 are provided between the corrugated paperboard sheet feed port of the folder-gluer 1 and the upstream region of the second bending station 10, in a tensioned state, and configured to be driven by a drive pulley 23 so as to convey the corrugated paperboard sheet SS in cooperation with the pair of upper conveyor belts 12.

As illustrated in FIGS. 3, 4, 7, 10 and 11, in the first bending station 8, a pair of bending plates 26 are attached to the lower frame 2*b* at respective positions on both sides of the conveyance pathway PL. Each of the bending plates 26 comprises a first bending plate 28 disposed on an upstream side, and a second bending plate 30 disposed on a downstream side in continuous relation to the first bending plate 28.

Each of the first bending plates 28 is fixedly installed to the lower frame 2*b*, and configured such that a distal end 28*a* thereof has an edged shape, and comes into contact with a respective one of the crease line formed in a reverse surface of the first panel P1 or a vicinity of the crease line, and the crease line formed in a reverse surface of the fourth panel P4 or a vicinity of the crease line, to thereby facilitate bending an associated one of the first and fourth panels P1, P4 along the crease line formed in the reverse surface thereof, in cooperation with a corresponding one of the bending bars 20. Each of the first bending plates 28 is not limited to be configured by one plate, but may be configured by connecting a plurality of plates (for example, 3 plates) arranged along the conveyance direction PD.

As with the first bending plates 28, each of the second bending plates 30 is configured such that a distal end 30*a* thereof has an edged shape, and comes into contact with a respective one of the crease line K2 of the first panel P1 or a vicinity thereof, and the crease line K4 of the fourth panel P4 or a vicinity thereof, to thereby facilitate bending an associated one of the first and fourth panels P1, P4 along the crease line thereof, in cooperation with a corresponding one of the bending bars 20.

The bending bar 20 corresponds to an example of the "first bending member" in the present invention, and the second bending plate 30 corresponds to an example of the "second bending member" in the present invention. Although the bending bar 20 and the second bending plate 30 are each configured by a pair of members, only one of the pair of members will be described for convenience of explanation.

In the second bending plate 30, as shown in FIG. 12, a distal end part 30*b*, including the distal end 30*a* in contact with the first and fourth panels P1, P4, and a main body part 30*c* are separately configured. Specifically, the distal end part 30*b* and the main body part 30*c* have their respective ends formed in an uneven shape, and are engaged with each other in the uneven-shaped portion and connected by a bolt 30*d*. By configuring the second bending plate 30 in this way, only the distal end part 30*b* can be removed from the main body part 30*c* and replaced. The first bending plate 28 may also be configured so that the distal end part can be removed from the main body part in the same way as the second bending plate 30.

Next, as illustrated in FIGS. 7 to 11, each of the second bending plates 30 is configured such that a downstream portion thereof is swingingly movable outwardly in the width direction by a given distance (for example, 2 mm), about an upstream end thereof serving as a support point 30*b* (rotational center). The lower frame 2*b* is fixedly provided with a rib 31 as a support member, which extends along each of the bending plates 28 horizontally and outwardly from the lower frame 2*b*. A plurality of guide members 33 are connected to the inside in the width direction of each of the second bending plates 30, and each of the guide members 33 engages with the rib 31 of the lower frame 2*b*. Specifically, the pair of guide members 33 arranged in the vertical direction are disposed so as to sandwich the rib 31 from opposite sides thereof (see FIGS. 8 and 10), in such a manner that they can be slidingly moved in the width direction WD with respect to the rib 31. In this case, the surface of the guide members 33 contacting the rib 31 is configured by a material softer than the material of the rib 31, and a so-called slide plate which does not require lubrication by oiling is applied to the guide members 33.

When each of the second bending plates 30 is slidingly moved outwardly in the width direction, the guide member 33 connected to the second bending plate 30 is slidingly moved with respect to the rib 31 fixed to the lower frame 2*b* in a horizontal posture. Thus, the second bending plate 30 is allowed to be moved only in a horizontal direction. Preferably, a movement distance (given distance) of each of the second bending plates 30 toward an outward side in the width direction is approximately one-half of a widthwise dimension of each of the slit-like slots S1, S3, S4, S6 of the corrugated paperboard sheet SS. Each of the first bending plates 28 and the second bending plates 30 is configured such that a width direction WD position thereof can be adjusted depending on the widthwise distance CNW of the corrugated paperboard sheet SS by a widthwise positioning mechanism (not illustrated).

As illustrated in FIG. 10, in order to push each of the second bending plates 30 outwardly in the width direction to swingingly move it, an air cylinder 32 which applies the push-out force to the second bending plates 30 is attached to the lower frame 2*b* in the vicinity of a downstream end of the second bending plate 30 (see also FIGS. 8 and 9). The vicinity of the downstream end of the second bending plate 30 is a zone in which a bending angle of each of the first and fourth panels P1, P4 of the corrugated paperboard sheet SS reaches about 90 degrees. The air cylinder 32 is operable, according to an on-off operation of a solenoid valve (not illustrated), to send high-pressure air into a cylinder 32*a* to thereby move a piston so as to cause a rod 32*b* to protrude outwardly in the width direction. Thus, by applying the push-out force of the air cylinder 32 to the second bending plates 30 in the width direction, the second bending plate 30 is moved outwardly in the width direction along with a sliding movement of the guide member 33 on a surface of the rib 31.

Further, a stopper mechanism 36 for regulating an amount of push-out (widthwise movement) of the second bending plate 30 by the air cylinder 32 is provided near a connection point with the lower frame 2*b* in the air cylinder 32. The stopper mechanism 36 is configured by a bolt and screw mechanism, and provided with a nut 36*b* that functions as a stopper to regulate the movement of the piston 32*b* and the rod 32*c* in the air cylinder 32. By adjusting the position of the nut 36*b* in the width direction, it is possible to variously set an amount for regulating a protrusion amount (i.e., a movement amount of the second bending plate 30 outward in the width direction) of the rod 32*c* in the air cylinder 32.

Further, as illustrated in FIG. 11, two return spring mechanisms 34 for returning the second bending plate 30 inwardly in the width direction and a push-out spring mechanism 37 for pushing the second bending plate 30 outwardly in the width direction are provided in the position of the second bending plate 30 and the lower frame 2*b* on the downstream side of the air cylinder 32 (see also FIGS. 8 and 9). The return spring mechanism 34 comprises: a rod member 34*a* having a distal end fixed to the inner surface of the second bending plate 30 and movable integrally with the swinging movement of the second bending plate 30; and a return spring 34*b* interposed between the rod member 34*a* and the lower frame 2*b*. The return spring mechanism 34 generates an elastic force to bias the second bending plate 30 inwardly in the width direction, when the return spring 34*b* is compressed, typically when the second bending plate 30 is pushed outwardly in the width direction.

The push-out spring mechanism 37 includes a push-out spring 37*a* which applies a push-out force to the second bending plate 30 to push the second bending plate 30 outwardly in the width direction and swingingly move it. Additionally, the push-out spring mechanism 37 includes: a housing 37*b* which houses the push-out spring 37*a*; a block member 37*c* which fixes the housing 37*b* to the second bending plate 30 and to which an end portion of the push-out spring 37*a* outwardly in the width direction is attached; a spacer member 37*d* to which an end portion of the push-out spring 37*a* inwardly in the width direction is attached; and a bolt and screw mechanism 37*e*, a tip end of which is attached to the spacer member 37*d*. The push-out spring mechanism 37 generates an elastic force to bias the second bending plate 30 outwardly in the width direction, when the push-out spring 37*a* is compressed, typically when the second bending plate 30 is pushed inwardly in the width direction.

Further, by adjusting the position of the bolt and screw mechanism 37*e* so as to change the position of the spacer member 37*d* in the width direction, the push-out spring mechanism 37 can vary an initial compression amount (specifically, a compression amount of the push-out spring 37*a* in a state where the second bending plate 30 is not pushed outwardly in the width direction by the air cylinder 32) of the push-out spring 37*a*, one end portion of which is attached to the spacer member 37*d*. Thus, the elastic force applied to the second bending plate 30 by the push-out spring 37*a* (i.e., the push-out force for pushing the second bending plate 30 outwardly in the width direction) can be varied.

The air cylinder 32 and the push-out spring mechanism 37 correspond to an example of the "push-out device" in the present invention.

Figure 13:
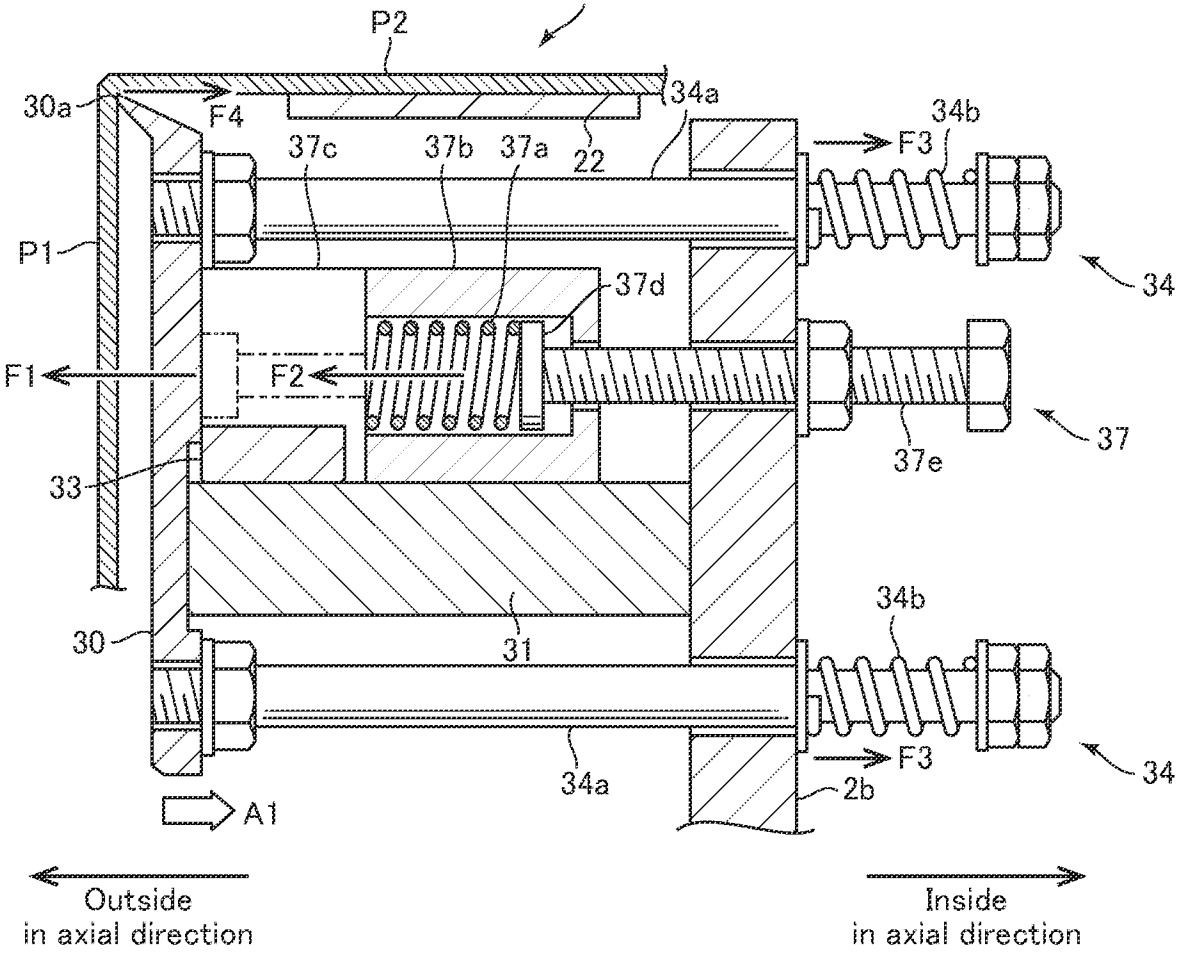
FIG. 13 is an explanatory diagram of the extension operation of the corrugated paperboard sheet by the second bending plate according to this embodiment.

Next, with reference to FIG. 13, an operation in which the second bending plate 30 extends the first and fourth panels P1, P4 of the corrugated paperboard sheet SS in this embodiment will be described. FIG. 13 is an enlarged cross-sectional view of the folder-gluer taken along the line X-X in FIG. 8, as with FIG. 10. In FIG. 13, "F1" indicates a force (push-out force, in other words, thrust) applied to the second bending plate 30 by the air cylinder 32 (not shown in FIG. 13) outwardly in the width direction. "F2" indicates a force (push-out force, in other words, elastic force) applied to the second bending plate 30 by the push-out spring mechanism 37 outwardly in the width direction. "F3" indicates a force (elastic force) applied to the second bending plate 30 by each of the two return spring mechanisms 34 inwardly in the width direction. "F4" indicates a force (resistance force due to bending) applied to the second bending plate 30 by the first and fourth panels P1, P4 which are being bent, inwardly in the width direction.

First, before a production of the corrugated paperboard box is started, the air cylinder 32 is operated, and thereby the second bending plate 30 is set to a state of being pushed outwardly in the width direction by a predetermined distance from the initial position (this means the same position as the first bending plate 28 in the width direction WD (the same shall apply hereinafter)), by the push-out force F1 of the air cylinder 32 and the push-out force F2 of the push-out spring mechanism 37. In the state, the production of the corrugated paperboard box is started, and the corrugated paperboard sheet SS is conveyed from the upstream side of the folder-gluer 1. When the first and fourth panels P1, P4 of the corrugated paperboard sheet SS to be conveyed reach the second bending plate 30, the first and fourth panels P1, P4 are extended in the width direction WD by the second bending plate 30 which is pushed outwardly in the width direction, and fold lines of the first and fourth panels P1, P4 are moved outwardly in the width direction. At this time, the first and fourth panels P1, P4 are bent at about 90 degrees by the bending bar 20 of the folder-gluer 1.

When the first and fourth panels P1, P4 are bent by the second bending plate 30, the resistance force F4 is applied to the second bending plate 30 inwardly in the width direction, by the first and fourth panels P1, P4 which are being bent. Specifically, when the downstream portions of the first and fourth panels P1, P4 (typically the downstream half of the first and fourth panels P1, P4) are passing through the second bending plate 30, the magnitude of the resistance force F4 is relatively small. Therefore, at this time, the second bending plate 30 is maintained in a state of being pushed outwardly in the width direction, by the push-out forces F1 and F2 outwardly in the width direction by the air cylinder 32 and the push-out spring mechanism 37, and the downstream portions of the first and fourth panels P1, P4 are extended in the width direction WD by the second bending plate 30 in this state.

Thereafter, as the downstream end of the corrugated paperboard sheet SS is advanced to the downstream side in the conveyance direction PD and the bending angles of the first and fourth panels P1 and P4 increase, and accordingly, the resistance force F4 applied to the second bending plate 30 by the first and fourth panels P1, P4 which are being bent increases. Therefore, when the upstream portions relative to the above downstream portions of the first and fourth panels P1, P4 (typically, the upstream half of the first and fourth panels P1, P4) are passing through the second bending plate 30, the second bending plate 30 is pushed back inwardly in the width direction, by the increased resistance force F4 by the first and fourth panels P1, P4 inwardly in the width direction and the force F3 by each of the return spring mechanisms 34 inwardly in the width direction (see an arrow A1 in FIG. 13). Typically, the second bending plate 30 is pushed back to the above initial position or a position close to the initial position. Hence, the upstream portions of the first and fourth panels P1, P4 are not extended in the width direction WD by the second bending plate 30.

Then, when the first and fourth panels P1, P4 have finished passing through the second bending plate 30, that is, when the upstream ends of the crease line portions of the first and fourth panels P1, P4 pass through the downstream ends of the second bending plate 30, the resistance force F4 is no longer applied to the second bending plate 30 from the first and fourth panels P1, P4. Therefore, the second bending plate 30 quickly returns to the state of being pushed outwardly in the width direction by the predetermined distance, by the push-out forces F1, F2 outwardly in the width direction by the air cylinder 32 and the push-out spring mechanism 37. Thereafter, the operation of extending the downstream portions of the first and fourth panels P1, P4 of the corrugated paperboard sheet SS conveyed to the folder-gluer 1 is repeated in the same manner as described above, until the production of the corrugated paperboard box is completed.

As described above, in this embodiment, the upstream portions of the first and fourth panels P1, P4 are not extended in the width direction WD by the second bending plate 30, and only the downstream portions of the first and fourth panels P1, P4 are extended in the width direction WD by the second bending plate 30. The extension operation of the first and fourth panels P1, P4 by the second bending plate 30 is realized by appropriately setting the push-out forces F1 and F2 by the air cylinder 32 and the push-out spring mechanism 37.

In the folder-gluer 1 of this embodiment, the push-out forces F1 and F2 by the air cylinder 32 and the push-out spring mechanism 37 are set such that: (1) when the downstream portions of the first and fourth panels P1, P4 are passing through the second bending plate 30, the second bending plate 30 is set to a state of being pushed outwardly in the width direction by the push-out forces F1 and F2, and the downstream portions of the first and fourth panels P1, P4 are extended in the width direction WD by the second bending plate 30 in this state; (2) next, when the upstream portions relative to the above downstream portions of the first and fourth panels P1, P4 are passing through the second bending plate 30, the second bending plate 30 is set to a state of being pushed back inwardly in the width direction by the resistance force F4 applied to the second bending plate 30 by the first and fourth panels P1, P4 which are passing, and the upstream portions of the first and fourth panels P1, P4 are not extended in the width direction WD by the second bending plate 30; and (3) next, when the first and fourth panels P1, P4 have finished passing through the second bending plate 30, the second bending plate 30 is returned to the state of being pushed outwardly in the width direction by the push-out forces F1 and F2, wherein the push-out forces F1 and F2 are not varied by a control while the first and fourth panels P1, P4 are passing through the second bending plate 30.

For example, by experiments, predetermined arithmetic expressions or simulations, the resistance force F4 applied to the second bending plate 30 by bending the first and fourth panels P1, P4 may be calculated, derived or estimated from the various corrugated paperboard sheets SS, and the push-out forces F1 and F2 to be applied to the second bending plate 30 by the air cylinder 32 and the push-out spring mechanism 37 may be determined based on the resistance force F4, so that the state of the second bending plate 30 in each of the above-mentioned situations (1) and (2) is appropriately realized. In this case, since the push-out forces F1 and F2 vary in accordance with the widthwise position of the second bending plate 30 while the first and fourth panels P1, P4 are passing through the second bending plate 30, as an example, on the basis of the time when the first and fourth panels P1, P4 are not passing through the second bending plate 30 (that is, the time when the second bending plate 30 is moved outwardly in the widthwise direction by the predetermined distance), the push-out forces F1 and F2 to be applied at this time may be determined. Further, the total value of the push-out forces F1 and F2 to be applied to the second bending plate 30 may be determined, and the total value may be distributed to the push-out force F1 of the air cylinder 32 and the push-out force F2 of the push-out spring mechanism 37. The push-out forces F1 and F2 thus determined can be realized in each of the air cylinder 32 and the push-out spring mechanism 37 by using adjustment mechanisms (FIG. 15) described later. In order to determine the push-out forces F1 and F2 based on the resistance force F4, the force F3 by each of the return spring mechanisms 34 may also be determined. That is, the magnitude of the force F3 to be applied in each of the return spring mechanisms 34 may be determined so as to ensure an appropriate balance between the resistance force F4 and the push-out forces F1 and F2.

According to this embodiment, similarly to the technique described in Patent Document 1, the occurrence of the fishtail can be prevented, since the upstream portions of the first and fourth panels P1, P4 are not extended in the width direction WD by the second bending plate 30, but only the downstream portions of the first and fourth panels P1, P4 are extended in the width direction WD by the second bending plate 30. In particular, according to this embodiment, the extension operation of the first and fourth panels P1, P4 can be realized by the push-out forces F1 and F2 which are set to the desired magnitude and are not varied by the control during the passage of the first and fourth panels P1, P4. That is, it is not necessary to use the sensor(s) and the control device as described in Patent Document 1, in order to realize the extension operation of the first and fourth panels P1, P4. Specifically, while the first and fourth panels P1, P4 are passing through the second bending plate 30, it is not necessary to control the push-out forces F1 and F2 applied to the second bending plate 30 by the control device according to the detection result of the sensor. Therefore, according to this embodiment, it is possible to appropriately produce the boxes having no fishtail while avoiding the increase in the cost of the apparatus.

The "downstream portion(s)" of the first and fourth panels P1, P4 which is extended in the width direction WD by the second bending plate 30 is not limited to the downstream half of the first and fourth panels P1, P4. In other words, the "upstream portion(s)" of the first and fourth panels P1, P4 which is not extended in the width direction WD by the second bending plate 30 is not limited to the upstream half of the first and fourth panels P1, P4. The "downstream portion(s)" only means that, when a portion which is not extended in the width direction WD by the second bending plate 30 is used as a comparative criterion, a portion which is extended in the width direction WD by the second bending plate 30 is located on the downstream side of portion corresponding to the comparative criterion. The same is true for the upstream portion(s).

Figure 14:
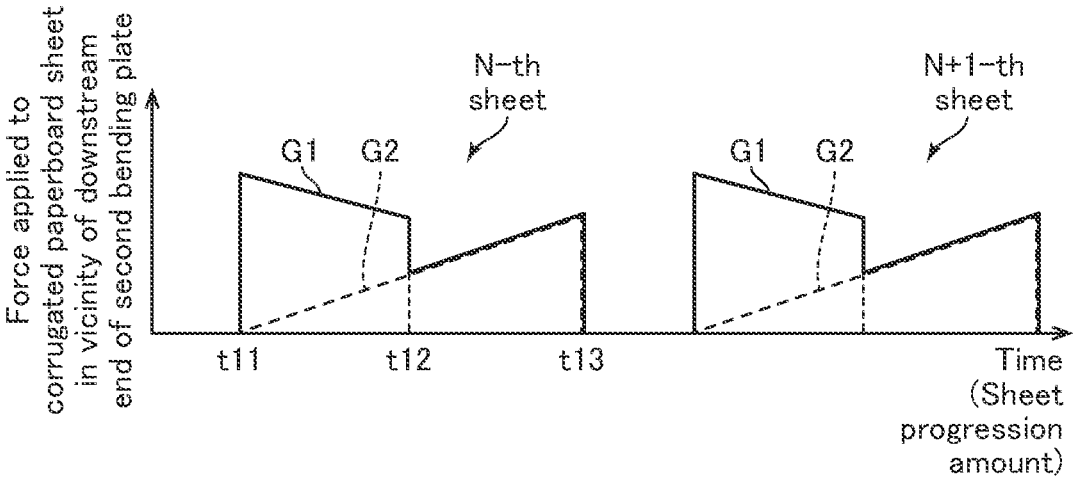
FIG. 14 is an explanatory diagram of the force applied to the corrugated paperboard sheet by the second bending plate according to this embodiment.

Next, with reference to FIG. 14, a force applied to the corrugated paperboard sheet SS by the second bending plate 30 in this embodiment will be described. In FIG. 14, a horizontal axis shows time (corresponding to an advancing amount of the corrugated paperboard sheet SS), and a vertical axis shows a force applied to the first and fourth panels P1, P4 of the corrugated paperboard sheet SS by the second bending plate 30 in the vicinity of the downstream end. Solid line graphs G1 show time variations of forces applied by the second bending plate 30 to the first and fourth panels P1, P4 of a N-th sheet and a N+1-th sheet, in this embodiment. In contrast, broken line graphs G2 show time variations of forces applied by the second bending plate 30 to the first and fourth panels P1, P4 of a N-th sheet and a N+1-th sheet, in a comparative example. In the comparative example, the second bending plate 30 does not move and is maintained at the same position as the first bending plate 28 in the width direction WD.

Figure 22:
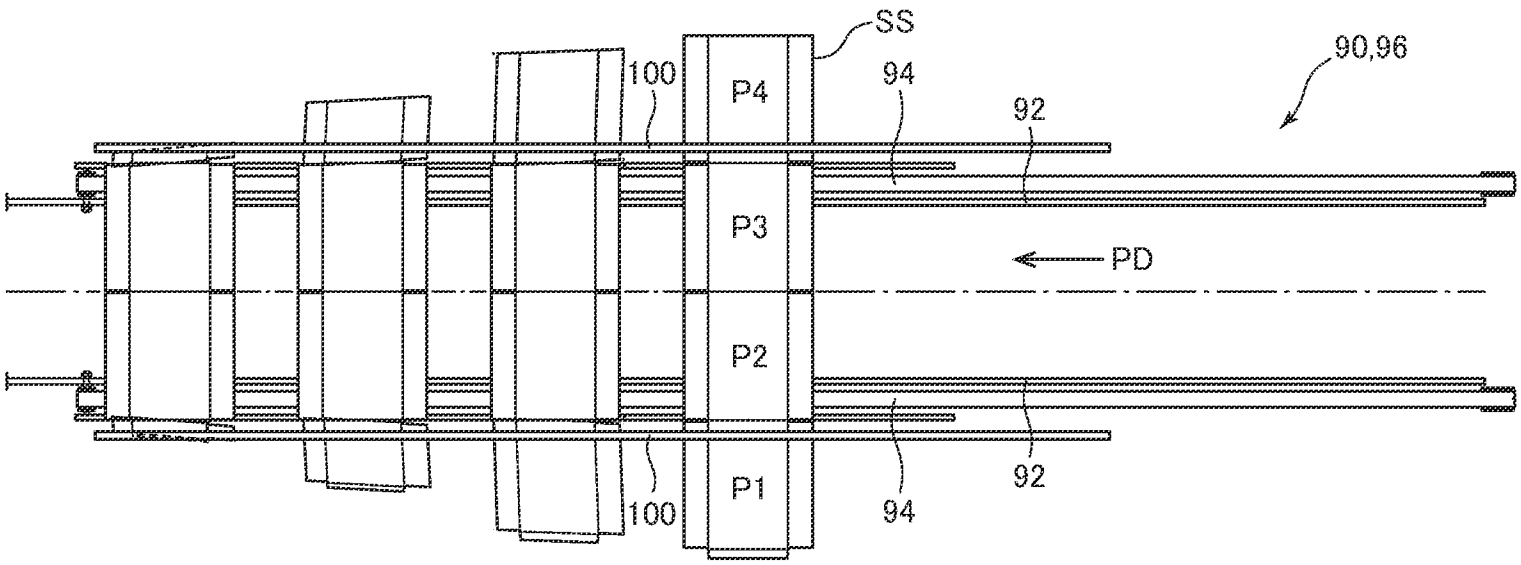
FIG.22 (Prior Art)
FIG. 22 is a top plan view illustrating the first bending station in FIG. 20.
Figure 23:
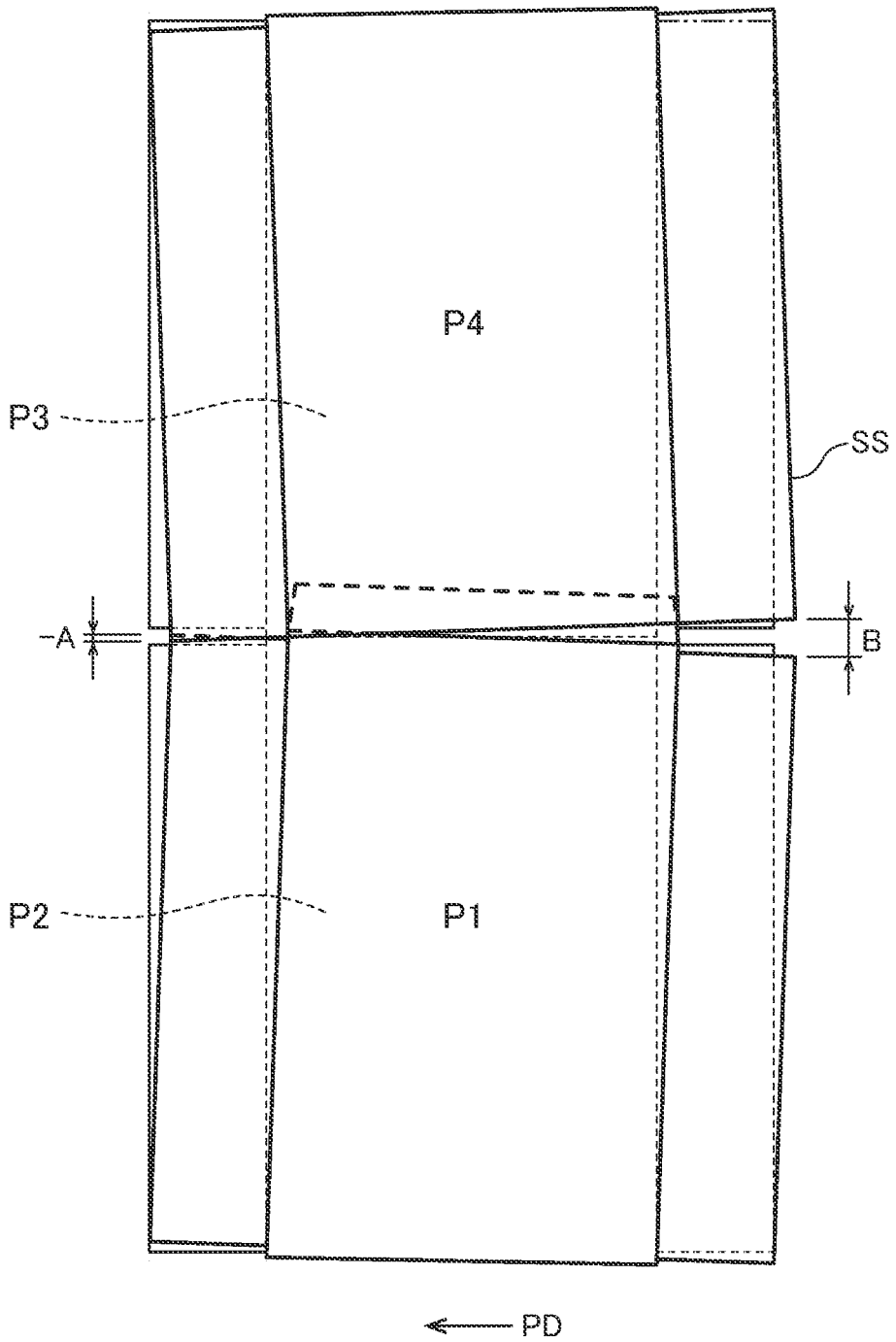
FIG.23 (Prior Art)
FIG. 23 is a back plan view illustrating fishtail occurring in the corrugated paperboard sheet folded by the conventional folder-gluer.

According to the comparative example, from time t11 when the first and fourth panels P1, P4 of the corrugated paperboard sheet SS to be conveyed reach the second bending plate 30 to time t13 when the first and fourth panels P1, P4 have finished passing through the second bending plate 30, the force applied to the first and fourth panels P1, P4 by the second bending plate 30 in the vicinity of the downstream end gradually rises from 0. When such a force is applied to the first and fourth panels P1, P4, the fishtail tends to occur as mentioned above (See FIGS. 22 and 23).

On the other hand, according to this embodiment, at the time t11 when the first and fourth panels P1, P4 of the corrugated paperboard sheet SS to be conveyed reach the second bending plate 30, the force applied to the first and fourth panels P1, P4 by the second bending plate 30 in the vicinity of the downstream end becomes maximum by the push-out forces F1 and F2 by the air cylinder 32 and the push-out spring mechanism 37. This is because, at the time t11, the resistance force F4 by the first and fourth panels P1, P4 has not yet been applied to the second bending plate 30. When the first and fourth panels P1, P4 are being bent after the time t11, the resistance force F4 applied to the second bending plate 30 by the first and fourth panels P1, P4 increases. Accordingly, the force applied to the first and fourth panels P1, P4 by the second bending plate 30 in the vicinity of the downstream end decreases. In this case, the second bending plate 30 is gradually pushed back inwardly in the width direction by the force F3 by the return spring mechanism 34 in addition to the resistance force F4 by the first and fourth panels P1, P4.

Thereafter, at time t12 when the downstream portions of the first and fourth panels P1, P4 have finished passing through the second bending plate 30, i.e., when the downstream ends of the upstream portions of the first and fourth panels P1, P4 reaches the downstream end of the second bending plate 30, the second bending plate 30 is set to a state of being pushed back to the substantially initial position by the forces F4 and F3 inwardly in the width direction from the first and fourth panels P1, P4 and the return spring mechanism 34. This state is the same as the state of the second bending plate 30 in the comparative example. Therefore, after the time t12, the force in this embodiment which is applied to the first and fourth panels P1, P4 by the second bending plate 30 in the vicinity of the downstream end is the same as in the comparative example.

Figure 15A:
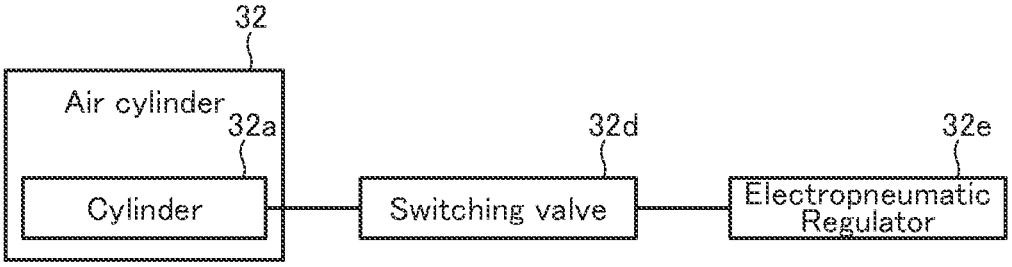
FIG. 15A is a block diagram schematically showing the adjustment mechanism of the push-out force by the air cylinder according to this embodiment.

Next, with reference to FIGS. 15A and 15B, an adjustment of the push-out force applied to the second bending plate 30 by the air cylinder 32 and the push-out spring mechanism 37 will be described. FIG. 15A is a block diagram schematically showing an adjustment mechanism of the push-out force by the air cylinder 32. As shown in FIG. 15A, an electropneumatic regulator 32*e* is connected to a cylinder 32*a* of the air cylinder 32 via a switching valve (solenoid valve) 32*d* for switching between supply and non-supply of high-pressure air to the cylinder 32*a*. The electropneumatic regulator 32*e* adjusts the pressure of the high-pressure air to be supplied to the air cylinder 32 by using a pressure sensor (not shown) provided on a supply path of the high-pressure air, thereby adjusting the push-out force applied to the second bending plate 30 by the air cylinder 32. In this case, the pressure of the high-pressure air to be supplied to the air cylinder 32 is determined based on the characteristics of the corrugated paperboard sheet SS to be conveyed, for example, the size, the weight and the material, and the electropneumatic regulator 32*e* is controlled so as to realize the determined pressure of the high-pressure air. Preferably, since a resistance applied to the second bending plate 30 increases as the basis weight (weight per square meter of the base paper) of the corrugated paperboard sheet SS to be conveyed increases, the electropneumatic regulator 32*e* may be controlled to increase the high-pressure air so as to increase the push-out force by the air cylinder 32 as the basis weight increases.

Figure 15B:
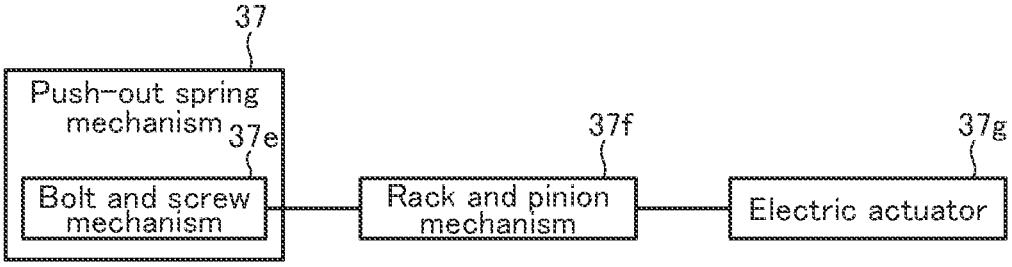
FIG. 15B is a block diagram schematically showing the adjustment mechanism of the push-out force by the push-out spring mechanism according to this embodiment.

FIG. 15B is a block diagram schematically showing an adjustment mechanism of the push-out spring mechanism 37. As shown in FIG. 15B, a rack and pinion mechanism 37*f* having a rack and a pinion capable of adjusting a position of a bolt and screw mechanism 37*e* is connected to the bolt and screw mechanism 37*e* of the push-out spring mechanism 37, and an electric actuator 37*g* having a robotic cylinder and a servomotor is connected to the rack and pinion mechanism 37*f*. The electric actuator 37*g* operates the rack and pinion mechanism 37*f* to adjust the position of the bolt and screw mechanism 37*e*. Therefore, an initial compression amount of the push-out spring 37*a* whose one end is connected to the bolt and screw mechanism 37*e* via the spacer member 37*d* is varied (see FIG. 11), so that the push-out force applied to the second bending plate 30 by the push-out spring mechanism 37 is adjusted. In this case, the initial compression amount (corresponding to an initial elastic force to be generated by the push-out spring 37*a*) to be set for the push-out spring 37*a* is determined based on the characteristics of the corrugated paperboard sheet SS to be conveyed, for example, the size, the weight and the material, and the electric actuator 37*g* is controlled so as to realize the determined initial compression amount. Preferably, since the resistance applied to the second bending plate 30 increases as the basis weight of the corrugated paperboard sheet SS to be conveyed increases, the electric actuator 37*g* may be controlled to increase the initial compression amount of the push-out spring 37*a* so as to increase the push-out force by the push-out spring mechanism 37 as the basis weight increases.

Figure 16:
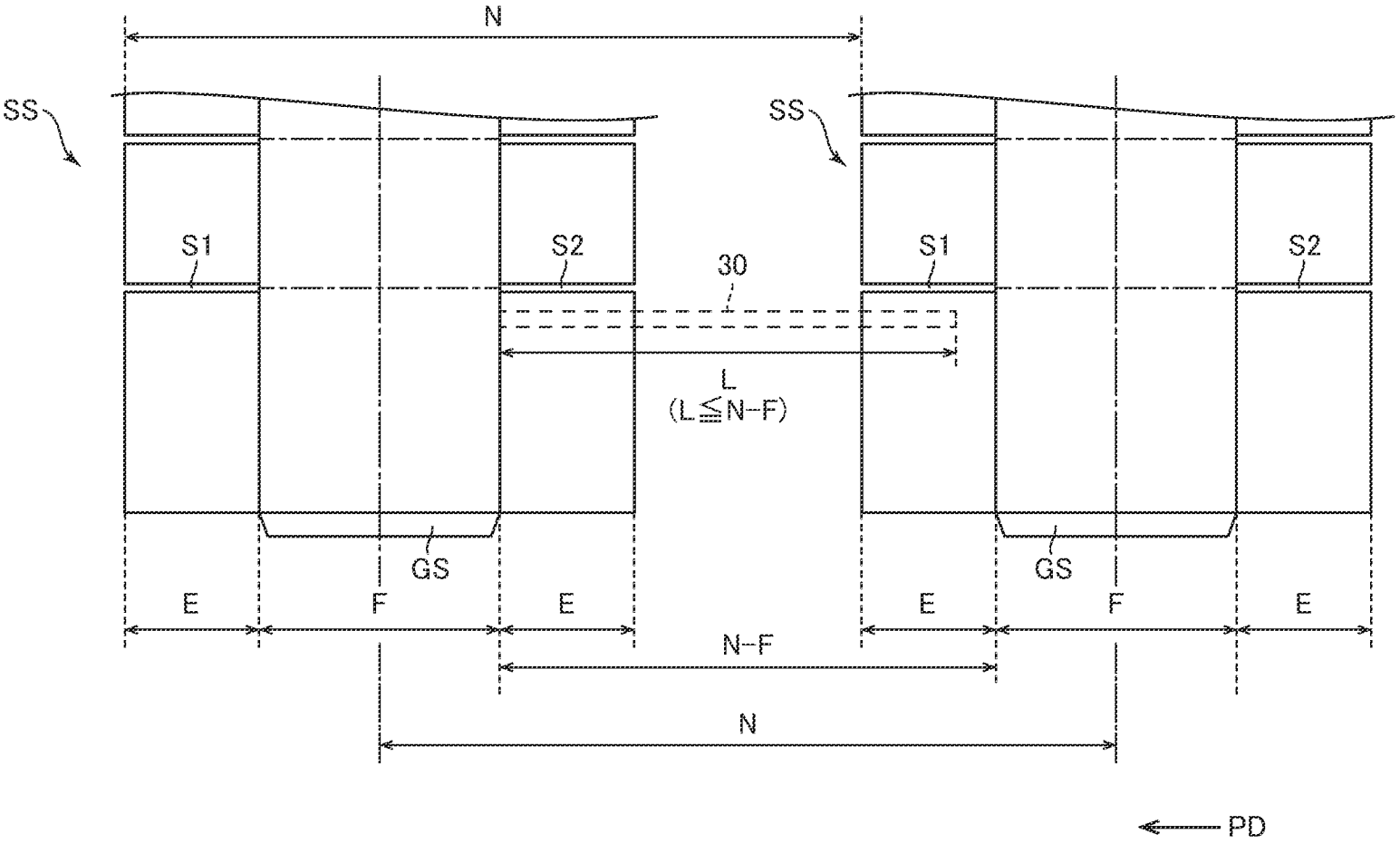
FIG. 16 is an explanatory diagram of the length of the second bending plate in the conveyance direction, according to this embodiment.

Next, with reference to FIG. 16, a length in the conveyance direction applied to the second bending plate 30 in this embodiment will be described. In this embodiment, as shown in FIG. 16, the second bending plate 30 is configured such that the length L of the second bending plate 30 in the conveyance direction is equal to or less than a length obtained by subtracting the box depth dimension F from a distance N (corresponding to a circumferential length of a printing cylinder of the printing unit provided on the upstream side of the folder-gluer 1 in the corrugated paperboard box making machine) between the leading edges of the two adjacent corrugated paperboard sheets SS in the conveyance direction, that is, a conditional equation "$L \leq N-F$" is satisfied. The right side "N−F" of the conditional equation corresponds to a distance between the upstream end of the panel portion of the preceding corrugated paperboard sheet SS and the downstream end of the panel portion of the following corrugated paperboard sheet SS in the two adjacent corrugated paperboard sheets SS in the conveyance direction PD. Preferably, the box depth dimension of the corrugated paperboard box having the largest box depth dimension among the various corrugated paperboard boxes produced by the corrugated paperboard box making machine is applied to the box depth dimension F in the conditional equation.

By applying the length L in the conveyance direction satisfying the above conditional equation, when the downstream end of the panel portion of the corrugated paperboard sheet SS to be conveyed reaches the upstream end of the second bending plate 30, it is possible to avoid that the second bending plate 30 is maintained in a state of being pushed back to a substantially initial position by the resistance applied by the panel portion of the adjacent preceding corrugated paperboard sheet SS. Therefore, when each of the panel portions in the corrugated paperboard sheets SS continuously conveyed reaches the second bending plate 30, the second bending plate 30 can be reliably returned to the state of being pushed outwardly in the width direction by the push-out forces F1, F2 by the air cylinder 32 and the push-out spring mechanism 37. Accordingly, the downstream portions of the first and fourth panels P1, P4 can be reliably extended in the width direction WD by the second bending plate 30, for each of the corrugated paperboard sheets SS continuously conveyed.

Figure 17:
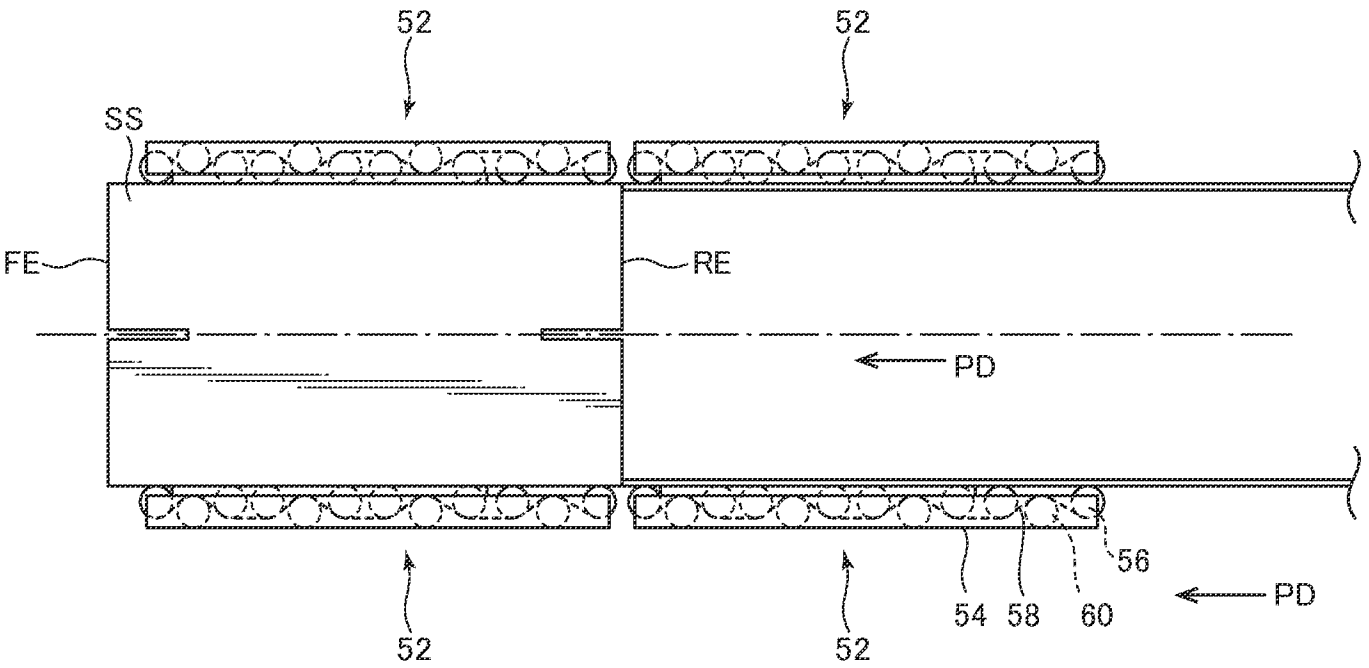
FIG. 17 is a top plan view illustrating a second bending station of the folder-gluer according to this embodiment.
Figure 18A:
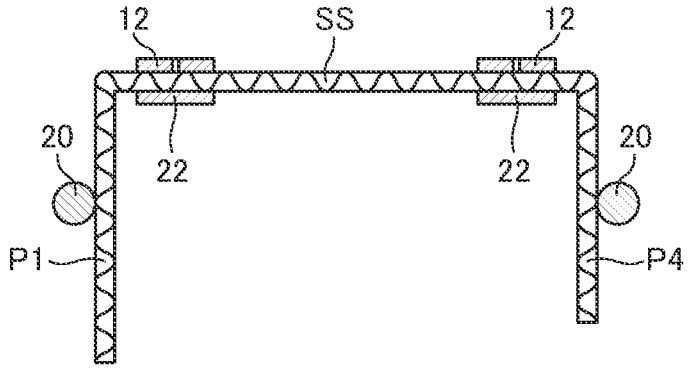
FIG. 18A is a sectional view illustrating a bent state of the corrugated paperboard sheet at a downstream end of the first bending station.
Figure 18B:
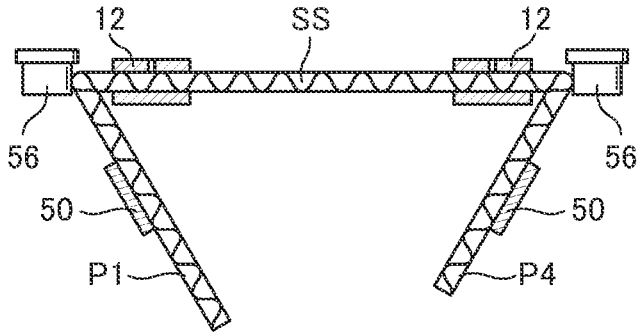
FIGS. 18B, 18C and 18D are, respectively, sectional views illustrating bent states of the corrugated paperboard sheet in the second bending station.
Figure 18C:
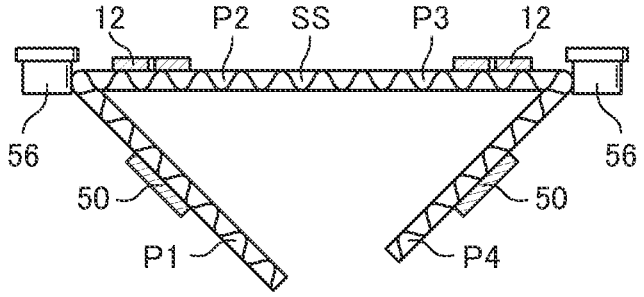
Figure 18D:
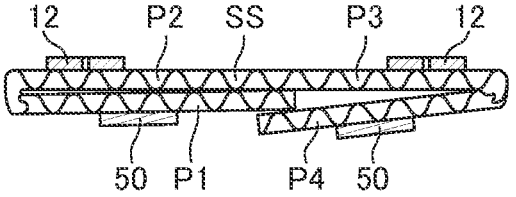

With reference to FIGS. 1, 17 and 18, the second bending station 10 of the folder-gluer 1 according to this embodiment will be described below.

As illustrated in FIG. 1, the second bending station 10 is equipped with a pair of panel bending belts 50 disposed, respectively, on left and right sides of the conveyance pathway PL, and configured to be driven so as to bend the first and fourth panels P1, P4 of the corrugated paperboard sheet SS, respectively, from about 90 degrees to 180 degrees; and two sets of a pair of guiding and regulating mechanisms 52 arranged along the conveyance direction PD, and configured to guide and regulate the bent connection regions of the first and fourth panels P1, P4.

Each of the panel bending belts 50 is disposed to extend over the overall length of the second bending station 10, wherein it has a contact surface contactable with an outer surface of an associated one of the first and fourth panels P1, P4. Each of the panel bending belts 50 is wound around a large number of rollers 50*a* in a tensioned state, in such a manner that the contact surface of the panel bending belt 50 positioned in a vertically standing posture at an upstream end of the second bending station 10 in the conveyance direction PD is gradually inclined as being moved toward a downstream side, and finally positioned in a horizontal posture (see FIGS. 18B, 18C and 18D). A distance between the panel bending belts 50 in the width direction WD can be adjusted depending on the given widthwise distance CNW of the corrugated paperboard sheet SS.

As illustrated in FIG. 17, the two sets of a pair of guiding and regulating mechanisms 52 are provided, respectively, on upstream and downstream sides of the second bending station 10. The upstream and downstream sets are structurally the same, and the pair of guiding and regulating mechanisms 52 on the right and left sides in the conveyance line PL are also structurally the same. Each of the pair of guiding and regulating mechanisms 52 comprises: a support plate 54 fixed to the frame 2 of the folder-gluer 1; a group of eight gauge rolls 56 supported by the support plate 54; and a positioning mechanism (not illustrated) for variably positioning the support plate 54 in the width direction WD.

The eight gauge rolls 56 are arranged in a line along the conveyance direction PD, and rotatably supported by a lower surface of the support plate 54. The eight gauge rolls 56 are configured to be rotated by a drive motor (not illustrated) via a timing belt 58 and three tension pulleys 60. The support plate 54 is configured to be moved in the width direction WD (right-left direction) and positioned depending on the given widthwise distance CNW of the corrugated paperboard sheet SS. As illustrated in FIGS. 17 and 18, a pair of the groups of gauge rolls 56 are configured such that, during the operation of bending the corrugated paperboard sheet SS from about 90 degrees to 180 degrees, they come into contact with respective fold lines of the panels P1, P4 to regulate a widthwise movement of the corrugated paperboard sheet SS, and smoothly convey the corrugated paperboard sheet SS along the conveyance direction PD.

Figure 19A:
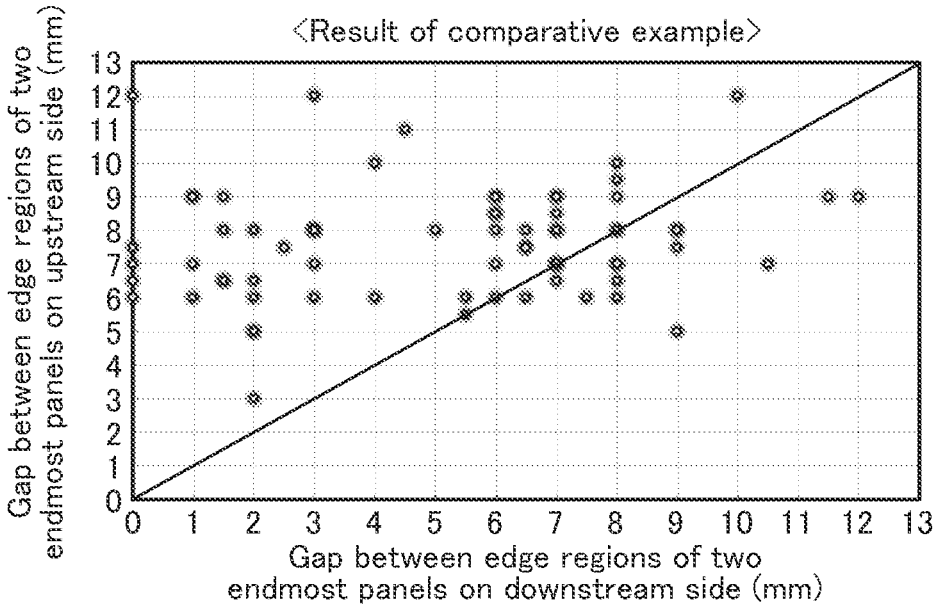
FIG. 19A shows a result of the corrugated paperboard sheet bent by the folder-gluer according to the comparative example.
Figure 19B:
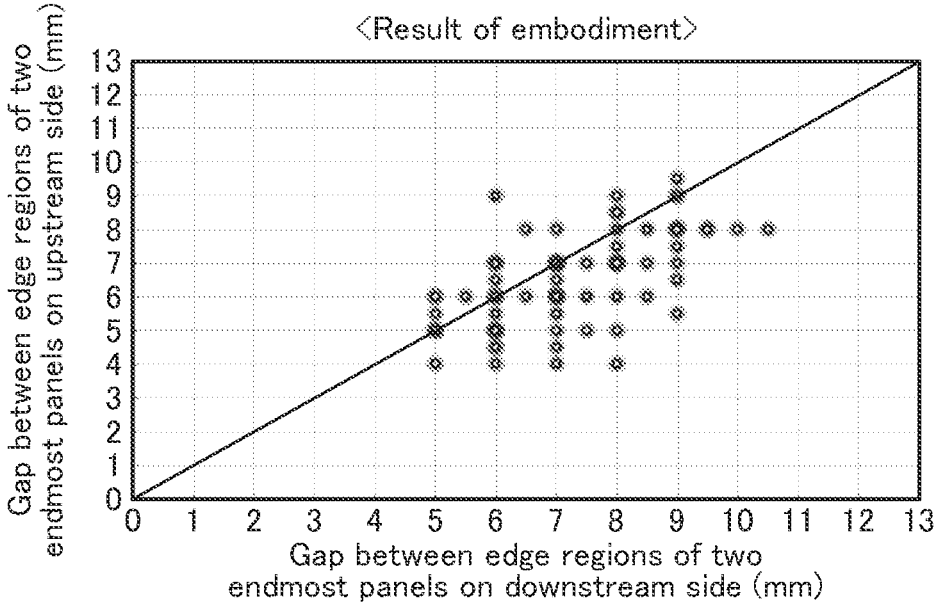
FIG. 19B shows a result of the corrugated paperboard sheet bent by the folder-gluer according to this embodiment of the present invention.

Next, with reference to FIGS. 19A and 19B, functions and effects according to the folder-gluer in this embodiment will be described. FIG. 19A shows a result of the corrugated paperboard sheet SS which is bent by the folder-gluer according to the comparative example, and FIG. 19B shows a result of the corrugated paperboard sheet SS which is bent by the folder-gluer according to this embodiment. In FIGS. 19A and 19B, a horizontal axis shows a gap (corresponding to the gap with the reference numeral A in FIG. 23, hereinafter referred to as "A gap") between the edge regions of the first and fourth panels P1, P4 on the downstream side in the corrugated paperboard sheet SS bent by the folder-gluer, and a vertical axis shows a gap (corresponding to the gap with the reference numeral B in FIG. 23, hereinafter referred to as "B gap") between the edge regions of the first and fourth panels P1, P4 on the upstream side in the corrugated paperboard sheet SS bent by the folder-gluer. Specifically, FIGS. 19A and 19B show scatter plots of points corresponding to the A gaps and the B gaps, for each of samples of the plurality of corrugated paperboard sheets SS bent by the folder-gluer according to the comparative example and this embodiment, respectively. The folder-gluer according to the comparative example does not move the second bending plate 30 but maintains it at the same position as the first bending plate 28 in the width direction WD.

As shown in FIG. 19A, in the corrugated paperboard sheets SS bent by the folder-gluer according to the comparative example, it can be seen that the gap of each sample is largely varied and that the B gap is too large relative to the A gap. That is, according to the comparative example, the fishtail occurs in a large number of corrugated paperboard sheets SS. On the other hand, in the corrugated paperboard sheets SS bent by the folder-gluer according to this embodiment, it can be seen that the gap variation of each sample is within a small range, especially that there are not too-small A gap and too-large B gap. That is, according to this embodiment, almost no fishtail occurs.

As mentioned above, in the folder-gluer 1 of this embodiment, the push-out forces F1 and F2 by the air cylinder 32 and the push-out spring mechanism 37 are set such that: (1) when the downstream portions of the first and fourth panels P1, P4 are passing through the second bending plate 30, the second bending plate 30 is set to a state of being pushed outwardly in the width direction by the push-out forces F1 and F2, and the downstream portions of the first and fourth panels P1, P4 are extended in the width direction WD by the second bending plate 30 in this state; (2) next, when the upstream portions relative to the above downstream portions of the first and fourth panels P1, P4 are passing through the second bending plate 30, the second bending plate 30 is set to a state of being pushed back inwardly in the width direction by the resistance force F4 applied to the second bending plate 30 by the first and fourth panels P1, P4 which are passing, and the upstream portions of the first and fourth panels P1, P4 are not extended in the width direction WD by the second bending plate 30; and (3) next, when the first and fourth panels P1, P4 have finished passing through the second bending plate 30, the second bending plate 30 is returned to the state of being pushed outwardly in the width direction by the push-out forces F1 and F2, wherein the push-out forces F1 and F2 are not varied by the control while the first and fourth panels P1, P4 are passing through the second bending plate 30.

Therefore, according to this embodiment, the occurrence of the fishtail in the corrugated paperboard sheet SS can be prevented by extending only the downstream portions of the first and fourth panels P1, P4 in the width direction WD by the second bending plate 30 without extending the upstream portions of the first and fourth panels P1, P4 in the width direction WD by the second bending plate 30, for the corrugated paperboard sheet SS to be conveyed. Especially, according to this embodiment, the extension operation of the first and fourth panels P1, P4 can be realized by using the push-out forces F1 and F2 which are set to the desired amount as described above and which are not varied by the control while the first and fourth panels P1, P4 are passing through the second bending plate 30. Therefore, it is not necessary to use the sensor(s) and the control device as described in Patent Document 1, in order to realize the extension operation of the first and fourth panels P1, P4. Specifically, while the first and fourth panels P1, P4 are passing through the second bending plate 30, it is not necessary to control the push-out forces F1 and F2 applied to the second bending plate 30 by the control device according to the detection result of the sensor. Accordingly, according to this embodiment, it is possible to appropriately produce the boxes having no fishtail while avoiding the increase in the cost of the apparatus.

Further, in this embodiment, the second bending plate 30 is configured such that the length L of the second bending plate 30 in the conveyance direction of the second bending plate 30 is equal to or less than the length obtained by subtracting the box depth dimension F from the distance N between the leading edges of the two adjacent corrugated paperboard sheets SS in the conveyance direction ($L \leq N-F$). Hence, when the downstream end of the panel portion of the corrugated paperboard sheet SS to be conveyed reaches the upstream end of the second bending plate 30, it is possible to avoid that the second bending plate 30 is maintained in a state of being pushed back to a substantially initial position by the resistance applied by the panel portion of the adjacent preceding corrugated paperboard sheet SS. Therefore, when each of the panel portions in the corrugated paperboard sheets SS continuously conveyed reaches the second bending plate 30, the second bending plate 30 can be reliably returned to the state of being pushed outwardly in the width direction by the push-out forces F1, F2 by the air cylinder 32 and the push-out spring mechanism 37. Accordingly, the downstream portions of the first and fourth panels P1, P4 can be reliably extended in the width direction WD by the second bending plate 30, for each of the corrugated paperboard sheets SS continuously conveyed.

Further, in this embodiment, both the air cylinder 32 and the push-out spring mechanism 37 are used to apply the push-out force to the second bending plate 30 outwardly in the width direction. First, the push-out spring mechanism 37 is more agile than the air cylinder 32, when the push-out spring mechanism 37 returns from a compressed state. Therefore, by using the push-out spring mechanism 37, when the first and fourth panels P1, P4 have finished passing through the second bending plate 30, the push-out force can be quickly applied to the second bending plate 30, and therefore the second bending plate 30 can be quickly returned to the state of being pushed outwardly in the width direction. Next, the air cylinder 32 has less variation in push-out force according to the widthwise position of the second bending plate 30, compared to the push-out spring mechanism 37, that is, the push-out force of the air cylinder 32 is less affected by the widthwise position of the second bending plate 30. Therefore, by using the air cylinder 32, it is possible to accurately realize a desired push-out force to be applied to the second bending plate 30 for performing the extension operation of the first and fourth panels P1, P4 as described above. Thus, by using both the air cylinder 32 and the push-out spring mechanism 37, it is possible to accurately perform a desired extension operation by the first and fourth panels P1, P4 when the first and fourth panels P1, P4 are passing through the second bending plate 30, and it is possible to quickly return the second bending plate 30 to the state of being pushed outwardly in the width direction when the first and fourth panels P1, P4 have finished passing through the second bending plate 30.

In a modification of this embodiment, only one of the air cylinder 32 and the push-out spring mechanism 37 may be used to apply the push-out force to the second bending plate 30 outwardly in the width direction. In such a case of using only the air cylinder 32, it is possible to accurately realize the push-out force to be applied to the second bending plate 30 for performing a desired extension operation of the first and fourth panels P1, P4, when the first and fourth panels P1, P4 are passing through the second bending plate 30. On the other hand, in such a case of using only the push-out spring mechanism 37 is used, it is possible to quickly return the second bending plate 30 to the state of being pushed outwardly in the width direction, when the first and fourth panels P1, P4 have finished passing through the second bending plate 30.

Further, in this embodiment, the initial compression amount of the push-out spring 37*a* of the push-out spring mechanism 37 is adjusted by using the electric actuator 37*g* to vary the push-out force by the push-out spring mechanism 37. Therefore, it is possible to accurately vary the push-out force by the push-out spring mechanism 37 by adjusting the initial compression amount of the push-out spring 37*a* according to the characteristics of the corrugated paperboard sheet SS to be conveyed, for example, the size, weight and material. Additionally, since the initial compression amount of the push-out spring 37*a* can be mechanically and accurately adjusted by the bolt and screw mechanism 37*e*, it is possible to appropriately equalize the push-out force between the operation side and the drive side.

Further, in this embodiment, the pressure of the high-pressure air supplied to the air cylinder 32 is adjusted by using the electropneumatic regulator 32*e* to vary the push-out force by the air cylinder 32. Therefore, it is possible to accurately vary the push-out force by the air cylinder 32 by adjusting the pressure of the high-pressure air supplied to the air cylinder 32 according to the characteristics of the corrugated paperboard sheet SS to be conveyed, for example, the size, weight and material.

By the way, when both the adjustment for varying the push-out force by the push-out spring mechanism 37 and the adjustment for varying the push-out force by the air cylinder 32 are performed, a plurality of combination patterns of the push-out force by the push-out spring mechanism 37 and the push-out force by the air cylinder 32 arise, and therefore the adjustment tends to be complicated. However, if the adjustment for varying the push-out force by the push-out spring mechanism 37 is not performed (that is, the initial compression amount of the push-out spring 37*a* is set to be constant) and only the adjustment for varying the push-out force by the air cylinder 32 is performed, the adjustment can be simplified.

Further, in this embodiment, the push-out spring 37*a* of the push-out spring mechanism 37 is housed in the housing 37*b*, and both ends of the push-out spring 37*a* are fixed. Therefore, the push-out spring 37*a* is not disposed to be biased downward in the gravity direction, in the housing 37*b*. Accordingly, it is possible to prevent a friction between the push-out spring 37*a* and the bottom surface inside the housing 37*b* in accordance with the expansion and contraction in the width direction WD.

It is not limited to fix both ends of the push-out spring 37*a*, but as another example, only one end of the push-out spring 37*a* may be fixed. According to the example, it is also possible to prevent the friction between the push-out spring 37*a* and the bottom surface inside the housing 37*b*.

Further, in this embodiment, the second bending plate 30 is provided with the guide member 33 which is engaged with the rib 31 of the lower frame 2*b* and slides with respect to the rib 31 so that the second bending plate 30 can move in the width direction. Therefore, since the second bending plate 30 moves in the width direction with the guide member 33 engaged with the rib 31 of the lower frame 2*b*, it is possible to ensure the accuracy of the movement in the traveling direction (substantially horizontal direction). Additionally, according to this embodiment, since the surface (in other words, the abutting surface, or the sliding surface) of the guide member 33 engaged with the rib 31 is made of a material softer than the material of the rib 31, the wear of the rib 31 can be suppressed by wearing only the guide member 33. Therefore, it is not necessary to replace the lower frame 2*b* which is a large component, and only the guide member 33 may be replaced. Accordingly, the time and effort required for the replacement work can be reduced, and the cost of the replacement work can be reduced at low cost.

Further, in this embodiment, the guide member 33 is configured by the member (so-called the slide plate) which does not require lubrication by oiling. Therefore, it is possible to eliminate the need for periodic oiling of the surface of the guide member 33 engaged with the rib 31.

Figure 20:
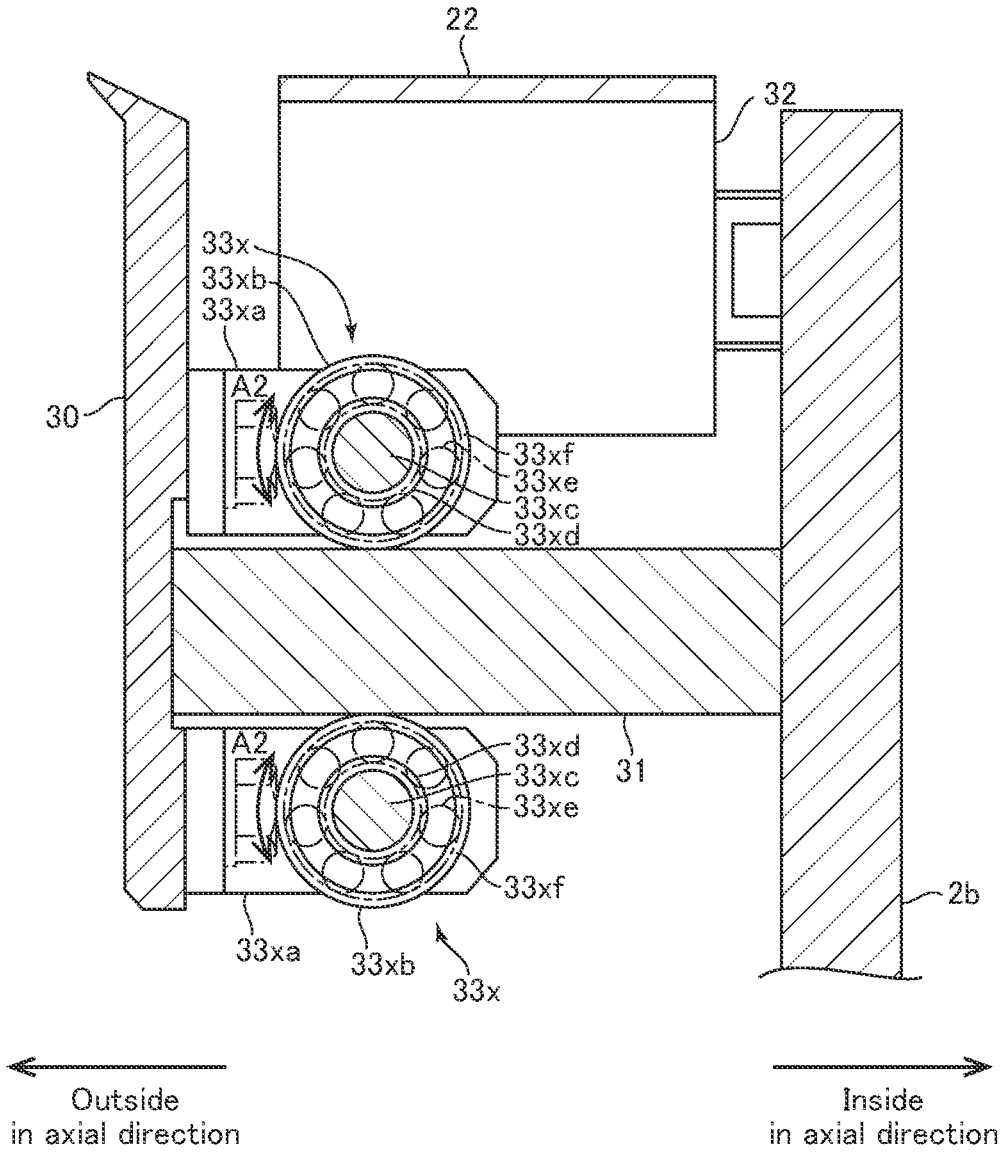
FIG. 20 is an enlarged cross-sectional view of the folder-gluer according to the modification of this embodiment.
Figure 21:
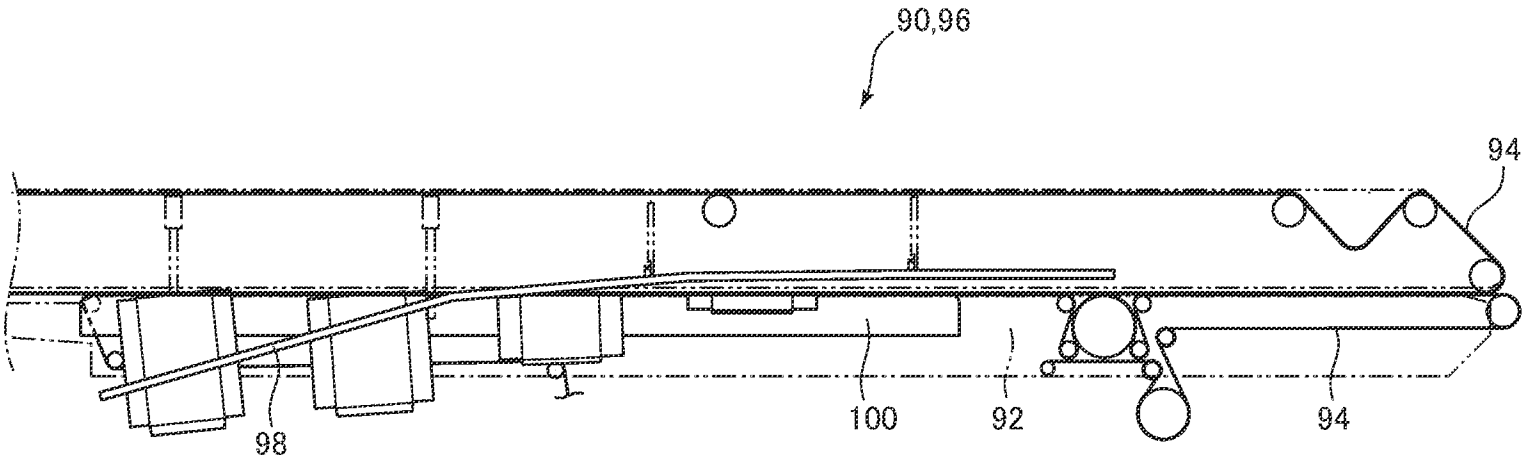
FIG.21 (Prior Art)
FIG. 21 is a side view of a first bending station of a conventional folder-gluer, illustrating a state in which the corrugated paperboard sheet is being bent by the conventional folder-gluer.

In a modification of this embodiment, instead of using the guide member 33 as described above, a guide member which is engaged with the rib 31 of the lower frame 2*b* and includes a rolling part configured to roll over the rib 31 so that the second bending plate 30 can move in the width direction may be used. With reference to FIG. 20, a guide member according to a modification of this embodiment will be described. FIG. 20 is an enlarged cross-sectional view of the folder-gluer viewed from the same direction as in FIGS. 10 and 11. As shown in FIG. 20, the guide member 33*x* according to the modification comprises a base part 30*xa* which has an end portion fixed to the second bending plate 30 and extends in the width direction, and a rolling part 33*xb* as a bearing (rolling bearing) attached to the base part 33*xa*. Specifically, the rolling part 33*xb* comprises: a shaft 33*xc* which is attached to the base part 33*xa* and extends in the conveyance direction PD; an inner ring 33*xd* fixed to the shaft 33*xc*; a plurality of rolling elements (balls) 33*xe* which is positioned outside the inner ring 33*xd* and arranged in an annular shape; and an outer ring 33*xf* (see an arrow A2) which is positioned outside the plurality of rolling elements 33*xe* and rolls over the rib 31 by abutting on the surface of the rib 31. A pair of the guide members 33*x* including the above rolling part 33*xb* is used, and the pair of guide members 33*x* are arranged to sandwich the rib 31 in the vertical direction.

According to the modification, since the second bending plate 30 moves in the width direction with the guide member 33*x* engaged with the rib 31 of the lower frame 2*b*, it is possible to ensure the accuracy of the movement in the traveling direction (substantially horizontal direction). Also, according to this modification, since the rolling part 33*xb* of the guide member 33*x* rolls over the rib 31 during the movement of the second bending plate 30 in the width direction, the wear of the rib 31 can be suppressed. Therefore, it is not necessary to replace the lower frame 2*b* which is a large component, and only the guide member 33*x* (especially, the rolling part 33*xb*) may be replaced. Accordingly, the time and effort required for the replacement work can be reduced, and the cost of the replacement work can be reduced at low cost.

In a further modification, a so-called free ball bearing (in other words, a ball caster) may be used as the rolling part of the guide member. The free ball bearing comprises one or more balls freely rotatable by 360 degrees, and a holding part (ball receiver) rotatably holding the one or more balls to abut them on the surface of the rib 31, and the free ball bearing rolls the one or more balls over the rib 31.

Further, in this embodiment, the second bending plate 30 is configured such that the distal end part 30*b* including the distal end 30*a* can be removed from the main body part 30*c*. Therefore, only the distal end part 30*b* including the distal end 30*a* which is prone to wear can be replaced. Accordingly, even if the distal end 30*a* wears, since it is not necessary to replace the entire second bent plate 30 which is a large component, the time and effort required for the replacement work can be reduced, and the cost of the replacement work can be reduced at low cost.

What is claimed is:

1. A folder-gluer for folding a corrugated paperboard sheet having first to fourth panels and a joint flap connected in a line through a respective connection region, the folder-gluer configured to fold each of the first panel and the fourth panel along the connection regions and glue the folded first and fourth panels together through the joint flap, the folder-gluer comprising:

a conveyance device configured to convey the corrugated paperboard sheet in a conveyance direction;

a pair of first bending members which extend in the conveyance direction, wherein the pair of first bending members come into contact, respectively, with outside surfaces of the first and fourth panels of the corrugated paperboard sheet so as to bend the first and fourth panels from 0 degree to about 90 degrees while the corrugated paperboard sheet is conveyed by the conveyance device;

a pair of second bending members which extend in the conveyance direction between the pair of first bending members, wherein the pair of second bending members comprise a pair of folding edges configured to engage, respectively, with a crease line, or a vicinity thereof, formed in a reverse surface of the first panel and a crease line, or a vicinity thereof, formed in a reverse surface of the fourth panel to further bend the first and fourth panels, while the corrugated paperboard sheet is conveyed by the conveyance device, in cooperation with the pair of first bending members;

a pair of push-out devices configured to apply a push-out force to push the pair of second bending members away from each other transversely to the conveyance direction, wherein engagement of the pair of second bending members with the corrugated paperboard sheet effects a resistance force that pushes the pair of second bending members toward each other transversely against the push-out force, the resistance force being effected to increase, as the corrugated paperboard sheet advances through the pair of second bending members, wherein the push-out device is further configured to:

(1) push the pair of second bending members away from each other along a first transversal distance therebetween, before the corrugated paperboard sheet arrives to engage with the folding edges of the pair of second bending members;

(2) responsive to the resistance force progressively increasing as the corrugated paperboard sheet advances through the pair of second bending members, push the pair of second bending members away from each other along a transversal distance therebetween progressively narrowing from the first transversal distance to prevent a tail end of the corrugated paperboard sheet from being extended transversely by the pair of second bending members no more than a transversal length of a leading end of the corrugated paperboard sheet; and (3) push the pair of second bending members away from each other along the first transversal distance therebetween, after the corrugated paperboard sheet leaves the folding edges of the pair of second bending members and before a next corrugated paperboard sheet arrives to engage with the folding edges of the pair of second bending members.

2. The folder-gluer according to claim 1, wherein, when a length of each of the pair of second bending members along the conveyance direction is defined as "L", and a distance in the conveyance direction between leading ends of two consecutive corrugated paperboard sheets is defined as "N", and a box depth dimension of a box produced by the corrugated paperboard sheet is defined as "F", the length L of the pair of second bending members satisfies an equation "$L \leq N-F$".

3. The folder-gluer according to claim 1, wherein the push-out device comprises a push-out spring which applies the push-out force to each of the second bending members by elasticity.

4. The folder-gluer according to claim 3, further comprising a mechanism capable of adjusting an initial compression amount of the push-out spring of the push-out device to vary a magnitude of the push-out force.

5. The folder-gluer according to claim 3, wherein the push-out spring of the push-out device is housed in a housing and one or both ends of the push-out spring are secured.

6. The folder-gluer according to claim 1, wherein each of the pair of push-out devices comprises an air cylinder which applies the push-out force to each of the pair of second bending members by high-pressure air.

7. The folder-gluer according to claim 6, further comprising a mechanism configured to adjust a pressure of the high-pressure air supplied to the air cylinder of the pair of push-out devices to vary a magnitude of the push-out force.

8. The folder-gluer according to claim 1, wherein the push-out device comprises:

a push-out spring which applies the push-out force to each of the second bending members by elasticity; and an air cylinder which applies the push-out force to each of the second bending members by high-pressure air.

9. The folder-gluer according to claim 1, further comprising a frame to which each of the pair of second bending members is attached, and which comprises a support member for supporting each of the pair of second bending members, wherein each of the pair of second bending members comprises a guide member which engages with the support member of the frame and slides with respect to the support member so that each of the pair of second bending members can move transversely, and wherein a surface of the guide member engaged with the support member is made of a material softer than a material of the support member.

10. The folder-gluer according to claim 9, wherein the guide member is further configured by a member which does not require lubrication by oiling.

11. The folder-gluer according to claim 1, further comprising a frame to which each of the second bending members is attached, and which comprises a support member for supporting each of the pair of second bending members, wherein each of the pair of second bending members comprises a guide member which engages with the support member of the frame and includes a rolling part configured to roll over the support member so that each of the pair of second bending members can move in the width direction.

12. The folder-gluer according to claim 1, wherein each of the pair of second bending members comprises a removable and replaceable distal end.

* * * * *